US007200346B2

(12) United States Patent
Chigira

(10) Patent No.: US 7,200,346 B2
(45) Date of Patent: Apr. 3, 2007

(54) IMAGE FORMING APPARATUS HAVING DIFFERENT DOTS PER UNIT AREA DENSITIES

(75) Inventor: Nobutoshi Chigira, Tokyo (JP)

(73) Assignee: Oki Data Corporation, Tokyo (JP)

( * ) Notice: Subject to any disclaimer, the term of this patent is extended or adjusted under 35 U.S.C. 154(b) by 129 days.

(21) Appl. No.: 10/786,522

(22) Filed: Feb. 25, 2004

(65) Prior Publication Data

US 2004/0165899 A1 Aug. 26, 2004

(30) Foreign Application Priority Data

Feb. 26, 2003 (JP) ..... 2003-048501

(51) Int. Cl.
*G03G 15/00* (2006.01)

(52) U.S. Cl. ..... 399/49

(58) Field of Classification Search ..... None
See application file for complete search history.

(56) References Cited

U.S. PATENT DOCUMENTS

| | | | | |
|---|---|---|---|---|
| 4,894,685 A | | 1/1990 | Shoji | |
| 5,436,705 A | * | 7/1995 | Raj | 399/59 |
| 5,859,933 A | | 1/1999 | Sasanuma et al. | |
| 5,873,010 A | | 2/1999 | Enomoto et al. | |
| 6,021,288 A | * | 2/2000 | Okuno et al. | 399/72 |
| 6,285,839 B1 | * | 9/2001 | Tanaka et al. | 399/49 |
| 6,336,008 B1 | * | 1/2002 | Nakazato et al. | 399/49 |
| 6,564,021 B1 | * | 5/2003 | Nakai et al. | 399/49 |
| 6,731,888 B2 | * | 5/2004 | Suzuki et al. | 399/49 |

FOREIGN PATENT DOCUMENTS

| | | |
|---|---|---|
| EP | 0628887 A2 | 12/1994 |
| JP | 05-244418 A | 9/1993 |
| JP | 7-248659 | 9/1995 |
| JP | 11-223966 | 8/1999 |

* cited by examiner

*Primary Examiner*—Robert Beatty
(74) *Attorney, Agent, or Firm*—Akin Gump Strauss Hauer & Feld, LLP

(57) ABSTRACT

An image-forming apparatus includes image-forming sections, a density detector, and a controller. Each image-forming section has an exposing unit and a developing unit. The image-forming section prints an image of a density detection pattern having a plurality of pattern segments of different duties. The image is printed on a print medium under a predetermined printing condition. The density detector outputs detection values indicative of densities of the plurality of pattern segments printed on the print medium. The controller determines a correction value based on the detection values and corresponding target values of density to modify the printing condition for the image-forming sections. The correction value may be a correction to the amount of light to be emitted from the exposing unit. The correction value may be a correction to the developing voltage to be supplied to the developing unit. The correction value may be weighted.

20 Claims, 12 Drawing Sheets

IMAGE FORMING APPARATUS HAVING DIFFERENT DOTS PER UNIT AREA DENSITIES

FIELD OF THE INVENTION

The present invention relates to an image-forming apparatus.

DESCRIPTION OF THE RELATED ART

A conventional image-forming apparatus such as an electrophotographic image-forming apparatus incorporates a plurality of image-forming sections. The image-forming sections include print engines for forming yellow, magenta, cyan, and black images, respectively. The print engines are aligned in a direction in which a medium-transporting belt runs. A change in environmental condition causes changes in toner characteristic and development characteristic. In order to address this problem, the density of a printed toner image is detected at appropriate timings for adjustment of the density of yellow, magenta, cyan, and black images.

FIG. 17 illustrates a conventional density detection pattern 112.

The density detection pattern 112 includes a black pattern 112*a*, a yellow pattern 112*b*, a magenta pattern 112*c*, and a cyan pattern 112*d*, and is transferred directly onto a transport belt 117. A density detecting means, not shown, includes a light-emitting section and a light-receiving section, which cooperate with each other to detect the density of the density detection pattern 112 printed on the transport belt 117.

The transport belt 117 transports the density detection pattern 112 printed thereon to the density detecting means, which in turn detects the density detection pattern 112 as the density detection pattern 112 passes over the density detecting means. By using the detected density, the density of toner images of the respective colors is corrected.

With the aforementioned conventional image-forming apparatus, the density detection pattern 112 printed on the transport belt 117 has a duty of 100%, i.e., a solid image. Accordingly, the density of an image having a duty of 100% can be controlled, but the density of a half-tone image cannot be sufficiently controlled. Therefore, when a full color photographic image is printed, color balance is not satisfactory.

SUMMARY OF THE INVENTION

The present invention was made to solve the drawbacks of the aforementioned image-forming apparatus.

An object of the invention is to provide an image-forming apparatus in which density detection patterns of different colors can be printed on a transport belt for detecting a low duty, a medium duty and high duty. The detected densities in the low, medium, and high duties can be used to achieve proper density adjustment of half tone images and hence appropriate color balance of, for example, a color photographic print image.

An image-forming apparatus includes:

at least one image-forming section that has an exposing unit and a developing unit, the at least one image-forming section printing an image of a density detection pattern having a plurality of pattern segments of different duties, the image being printed on a print medium under a predetermined printing condition;

a density detector that outputs detection values indicative of densities of the plurality of pattern segments printed on the print medium; and a controller that determines a correction value based on the detection values and corresponding target values to modify the printing condition.

The at least one image-forming section is one of a plurality of image-forming sections that print images of different colors.

The controller controls the image-forming section and the density detector to perform:

a first density detection operation in which the at least one image-forming section forms the image of density detection pattern with a first printing condition, and then the controller calculates a first correction value based on the density of the plurality of pattern segments detected by the density detector, the controller producing a second printing condition using the correction value; and a second density detection operation in which the image-forming section forms the image of density detection pattern with the second printing condition, and then the controller calculates a second correction value based on the density of the plurality of pattern segments detected by the density detector, the controller producing a second printing condition using the second correction value.

The plurality of pattern segments include a low duty segment, a medium duty segment, and a high duty segment;

wherein the low duty segment has a density not more than 50%, the medium duty segment has a density in the range of 30 to 80%, and the high duty segment has a density not less than 60%;

wherein densities of the low, medium, and high duty segments are related such that $D_L<D_M<D_H$ where $D_L$ is the density in the low duty, $D_M$ is the density in the medium duty, and $D_H$ is the density in the high duty.

The first correction value indicates a correction to an amount of light emitted from the exposing unit and the second correction value indicates a correction to a developing voltage applied to the developing unit, wherein the first correction value is calculated by Equation (1) and the second correction value is calculated by Equation (3)

$$Cl=(1/2)\{D_H\times(T_L/T_H)-D_L\}/K1+(1/2)\{D_H\times(T_M/T_H)-D_M\}/K2 \quad (1)$$

$$Cv=(1/3)(T_L-D_L)/K3+(1/3)(T_M-D_M)/K4+(1/3)(T_H-D_H)/K5 \quad (3)$$

where Cl is the first correction value,

Cv is the second correction value, $D_H$ is a density at a high duty not less than 60%, $D_M$ is a detected density at a medium duty in the range of 30 to 80%, $D_L$ is a density at a low duty not more than 50%, $T_H$ is a target density at the high duty, $T_M$ is a target density at the medium duty, $T_L$ is a detected density at the low duty,

K1 is a rate of change of $D_L$ per unit change of the amount of light emitted from the exposing unit,

K2 is a rate of change of $D_M$ per unit change of the amount of light emitted from the exposing unit,

K3 is a unit change of $D_L$ per unit change of the developing voltage,

K4 is a unit change of $D_M$ per unit change of the developing voltage,

K5 is a unit change of $D_H$ per unit change of the developing voltage, and $D_L$, $D_M$, and $D_H$ are related such that $D_L<D_M<D_H$.

The detected detection values may be sent to a host apparatus.

The plurality of pattern segments include a low duty segment and a medium duty segment. The low duty segment has a density not more than 50% and the medium duty segment has a density in the range of 30 to 80%. The densities of the low duty and the medium duty segments are related such that $D_L<D_M$ where $D_L$ is the density in the low duty, and $D_M$ is the density in the medium duty.

The first correction value indicates a correction to an amount of light emitted from the exposing unit and the second correction value indicates a correction to a developing voltage applied to the developing unit. The first correction value is calculated by Equation (4) and the second correction value is calculated by Equation (5), $$Cl=(1/2)\{(T_L-D_L)/K1+(T_M-D_M)/K2\} \quad (4)$$

$$Cv=(1/2)\{(T_L-D_L)/K3+(T_M-D_M)/K4\} \quad (5)$$

where Cl is the first correction value,

Cv is the second correction value, $D_H$ is a density at the high duty, $D_M$ is a detected density at the medium duty, $D_L$ is a density at the low duty, $T_H$ is a target density at the high duty, $T_M$ is a target density at the medium duty, $T_L$ is a detected density at the low duty, K1 is a rate of change of $D_L$ per unit change of the amount of light emitted from the exposing unit, K2 is a rate of change of $D_M$ per unit change of the amount of light emitted from the exposing unit, K3 is a unit change of $D_L$ per unit change of the developing voltage, K4 is a unit change of $D_M$ per unit change of the developing voltage, K5 is a unit change of $D_H$ per unit change of the developing voltage, and $D_L$, $D_M$, and $D_H$ are related such that $D_L<D_M<D_H$.

The first correction value indicates a correction to an amount of light emitted from the exposing unit and the second correction value indicates a correction to a developing voltage applied to the developing unit. The first correction value being calculated by Equation (6) and the second correction value being calculated by Equation (7).

$$Cl=(1/(W1+W2)\{D_H\times(T_L/T_H)-D_L\}\times W1/K1+(1/(W1+W2)\{D_H\times(T_M/T_H)-D_M\}\times 2/K2 \quad (6)$$

$$Cv=\{(T_L-D_L)\times W3/K3+(T_M-D_M)\times W4/K4+(T_H-D_H)\times W5/W5\}/(W3+W4+W5) \quad (7)$$

where Cl is the first correction value,

Cv is the second correction value, $D_H$ is a density at the high duty, $D_M$ is a detected density at the medium duty, $D_L$ is a density at the low duty, $T_H$ is a target density at the high duty, $T_M$ is a target density at the medium duty, $T_L$ is a detected density at the low duty, K1 is a rate of change of $D_L$ per unit change of the amount of light emitted from the exposing unit, K2 is a rate of change of $D_M$ per unit change of the amount of light emitted from the exposing unit, K3 is a unit change of $D_L$ per unit change of the developing voltage, K4 is a unit change of $D_M$ per unit change of the developing voltage, K5 is a unit change of $D_H$ per unit change of the developing voltage, $D_L$, $D_M$, and $D_H$ are related such that $D_L<D_M<D_H$, W1 is a weight used for correcting the amount of light in the low duty, W2 is a weight used for correcting the amount of light in the medium duty, W1 and W2 are related such that $W1\geqq W2$, and W3, W4, and W5 are weights used for correcting the developing voltages in the low, medium, and high duties, respectively, and W3, W4, and W5 are related such that $W3\geqq W4\geqq W5$.

The controller controls the image-forming section and the density detector to perform a first density detection operation in which the at least one image-forming section forms the image of density detection pattern with a printing condition. The controller calculates a correction value based on the density of the plurality of pattern segments detected by the density detector.

The plurality of pattern segments include a low duty segment, a medium duty segment, and a high duty segment. The low duty segment has a density not more than 50%, the medium duty segment has a density in the range of 30 to 80%, and the high duty segment has a density not less than 60%. The densities of the low, medium, and high duty segments are related such that $D_L<D_M<D_H$ where $D_L$ is the density in the low duty, $D_M$ is the density in the medium duty, and $D_H$ is the density in the high duty.

The first correction value indicates a correction to an amount of light emitted from the exposing unit and the second correction value indicates a correction to a developing voltage applied to the developing unit. The first correction value being calculated by Equation (1) and the second correction value being calculated by Equation (2);

$$Cl=(1/2)\{D_H\times(T_L/T_H)-D_L\}/K1+(1/2)\{D_H\times(T_M/T_H)-D_M\}/K2 \quad (1)$$

$$Cv=(1/3)\{T_L-(D_L+\Delta L\times K1)\}/K3+(1/3)\{T_M-(D_M+\Delta L\times K2)\}/K4+(1/3)\{T_H-D_H\}/K5 \quad (2)$$

where Cl is the first correction value,

Cv is the second correction value, $D_H$ is a density at the high duty, $D_M$ is a detected density at the medium duty, $D_L$ is a density at the low duty, $\Delta L$ is a change of amount of light, $T_H$ is a target density at the high duty, $T_M$ is a target density at the medium duty, $T_L$ is a detected density at the low duty, K1 is a rate of change of $D_L$ per unit change of the amount of light emitted from the exposing unit, K2 is a rate of change of $D_M$ per unit change of the amount of light emitted from the exposing unit, K3 is a unit change of $D_L$ per unit change of the developing voltage, K4 is a unit change of $D_M$ per unit change of the developing voltage, K5 is a unit change of $D_H$ per unit change of the developing voltage, and $D_L$, $D_M$, and $D_H$ are related such that $D_L<D_M<D_H$.

The energy for the developing section to develop the latent image is at least one of a developing voltage applied to a developing roller, a supply voltage applied to a toner supplying roller, and a charging voltage applied to a charging roller.

The energy for the latent image-forming section is an amount of light emitted from either an LED or a laser.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the invention will be described in detail with reference to the accompanying drawings.

First Embodiment

{Construction}

Figure 1:
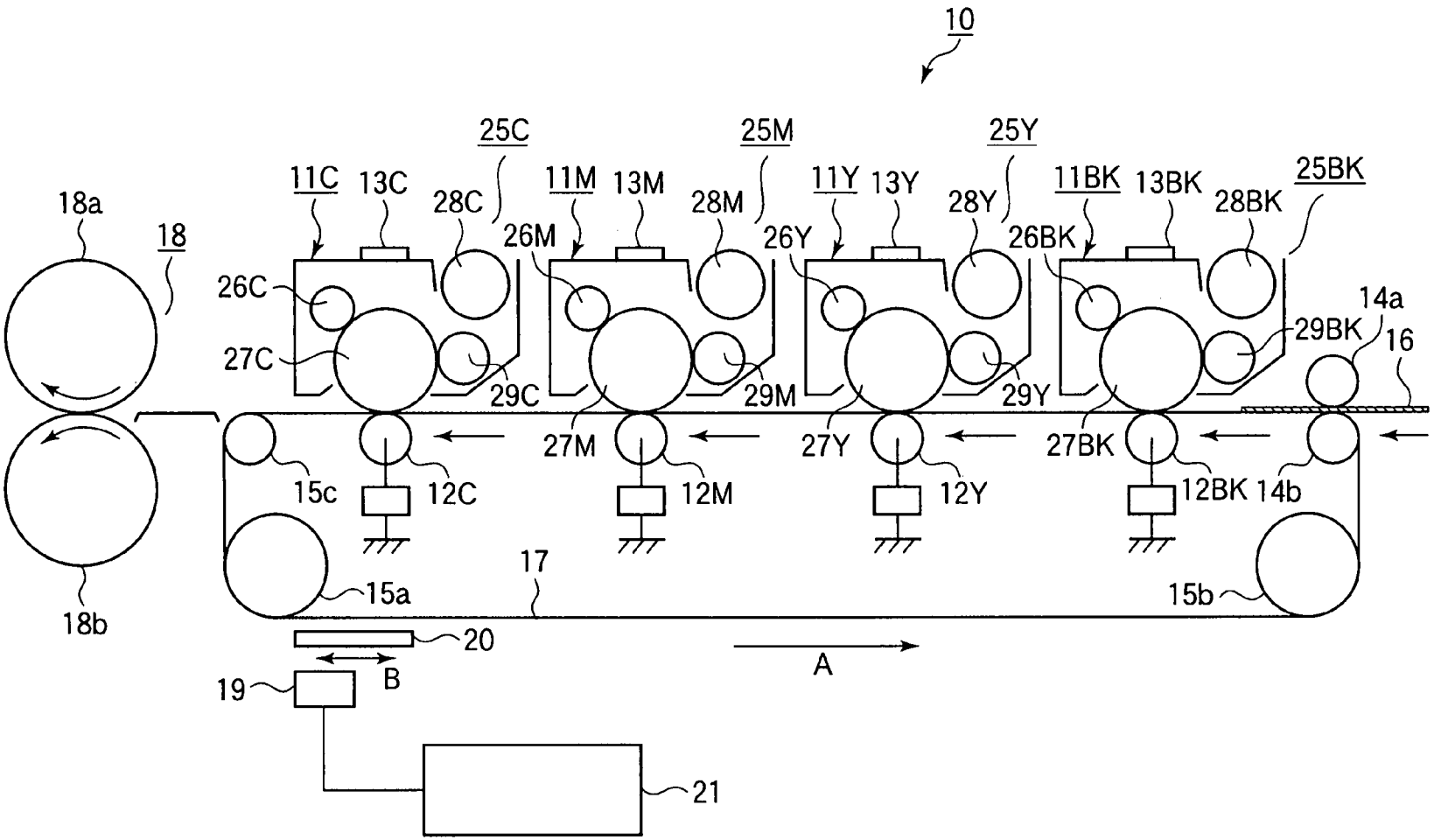
FIG. 1 illustrates the configuration of an image-forming apparatus according to a first embodiment of the invention.

FIG. 1 illustrates the configuration of an image-forming apparatus according to a first embodiment of the invention.

Referring to FIG. 1, an image-forming apparatus 10 takes the form of, for example, an electrophotographic printer, a facsimile machine, a printer, a copying machine, or a composite apparatus of these, in fact, the image-forming apparatus 10 can be any type of image-forming apparatus. By way of example, the present invention will be described with respect to a color electrophotographic printer.

The image-forming apparatus 10 includes image-forming sections 11BK, 11Y, 11M, and 11C for black, yellow, magenta, and cyan images, respectively, the image-forming sections being aligned in this order from an upstream end to a downstream end in a direction of travel of a print medium 16. The image-forming sections 11BK, 11Y, 11M, and 11C hold black, yellow, magenta, and cyan toners, respectively. The image-forming sections 11BK, 11Y, 11M, and 11C incorporate charging rollers 26BK, 26Y, 26M, and 26C, photoconductive drums 27BK, 27Y, 27M, and 27C, exposing units 13BK, 13Y, 13M, and 13C, and developing units 25BK, 25Y, 25M, and 25C. The developing units include developing rollers 29BK, 29Y, 29M, and 29C and toner supplying rollers 28BK, 28Y, 28M, and 28C. The charging rollers 26BK, 26Y, 26M, and 26C charge corresponding photoconductive drums 27BK, 27Y, 27M, and 27C, respectively. The exposing units take the form of, for example, LED heads 13BK, 13Y, 13M, and 13C and illuminate the charged surfaces of the photoconductive drums 27BK, 27Y, 27M, and 27C, respectively, to form an electrostatic latent image. The developing units 25BK, 25Y, 25M, and 25C supply the toner of the respective colors to the electrostatic latent images to develop the electrostatic latent images into visible toner images. Transfer rollers 12BK, 12Y, 12M, and 12C transfer the toner images of corresponding colors onto the print medium 16. Attraction rollers 14*a* and 14*b* charge the transport belt 17, so that the transport belt 17 attracts the print medium 16 thereto and transports the print medium 16 through the image-forming sections 11BK, 11Y, 11M, and 11C. Drive rollers 15*a*, 15*b*, and 15*c* are driven in rotation by a drive source, not shown, to rotate the transport belt 17 in a direction shown by arrow A.

The print medium 16 is advanced by a feeding mechanism, not shown, to the attraction rollers 14*a* and 14*b*, and then attracted to the transport belt 17, so that the print medium 16 advances at the same speed as the transport belt 17. As the print medium 16 passes through the image-forming sections 11BK, 11Y, 11M, and 11C in sequence, toner images of at least one or more colors are transferred onto the print medium 16. Thereafter, the print medium 16 leaves the transport belt 17 and is fed to a fixing unit 18 where the toner images on the print medium 16 are fused into a permanent image. The print medium 16 is then discharged to a stacker, not shown.

A density detector 19 is disposed under the transport belt 17 to detect a density detection pattern (FIG. 2) printed on the transport belt 17. The density detector 19 includes a light emitting section and a light receiving section, which cooperate with each other to detect the density of color toner images and a black toner image of the density detection pattern. A controller 21 controls overall operation of the apparatus. The controller cooperates with the density detector 19 to control the density of printed images. When the density of a toner image is to be detected, the print medium is not transported by the transport belt 17 but a density detection pattern is formed directly on the transport belt 17.

As the transport belt 17 runs in the direction shown by arrow A, the density detection pattern passes over the density detector 19 so that the density detector 19 detects the density detection pattern on the transport belt 17. In accordance with the density detected, the controller 21 controls the density of toner images.

A shutter 20 is normally at a closed position (FIG. 1) where the shutter 20 is between the transport belt 17 and the density detector 19, thereby protecting the density detector 19 from the toner and dust that would otherwise fall on the density detector 19. The shutter 20 moves in a direction shown by arrow B (FIG. 1) to an open position, thereby enabling detection of the density detection pattern on the transport belt 17.

{Density Detection Operation}

A density detection operation will be described. The density detector 19 detects the density of a low print duty pattern (hereinafter low duty pattern), a medium print duty pattern (hereinafter medium duty pattern), and a high print duty pattern (hereinafter high duty pattern). In the specification, the term "print duty" is used to cover the number of printed dots per unit area. The detected density values are put into Equation (1) to calculate a correction value Cl to the amount of light for each color, the light being used as a latent image-forming energy. The detected density values are put into Equation (2) to obtain a correction value Cv to the developing voltage for each color, developing voltage being used as a developing energy.

$$Cl=(1/2)\{D_H\times(T_L/T_H)-D_L\}/K1+(1/2)\{D_H\times(T_M/T_H)-D_M\}/K2 \quad (1)$$

$$Cv=(1/3)\{T_L-(D_L+\Delta L\times K1)\}/K3+(1/3)\{T_M-(D_M+\Delta L\times K2)\}/K4+(1/3)\{T_H-D_H\}/K5 \quad (2)$$

where $D_H$ is a density at a high duty not less than 60%;

$D_M$ is a detected density at a medium duty in the range of 30 to 80%;

$D_L$ is a density at a low duty not more than 50%;

$\Delta L$ is a change of amount of light, $T_H$ is a target density at the high duty;

$T_M$ is a target density at the medium duty;

$T_L$ is a detected density at the low duty;

K1 is a rate of change of $D_L$ per unit change of the amount of light emitted from the exposing unit;

K2 is a rate of change of $D_M$ per unit change of the amount of light emitted from the exposing unit;

K3 is a unit change of $D_L$ per unit change of the developing voltage;

K4 is a unit change of $D_M$ per unit change of the developing voltage; and

K5 is a unit change of $D_H$ per unit change of the developing voltage.

In most cases, values of $D_L$, $D_M$, and $D_H$ are such that related such that $D_H \geqq 60\%$, $30\% \geqq D_M \geqq 80\%$ and $D_L \geqq 50\%$. However, the measured values may not be accurately in these ranges. For example, in some cases, measured values of $D_L$, $D_M$, and $D_H$ can be 30%, 70%, 100%, respectively. In other cases, measured values of $D_L$, $D_M$, and $D_H$ can be 30%, 50%, 70%, respectively.

The energy to be supplied to the aforementioned developing unit is at least one of a developing voltage applied to a developing roller, a supply voltage applied to a toner supplying roller, and a charging voltage applied to a charging roller. The present embodiment will be described in terms of the developing voltage.

Figure 2:
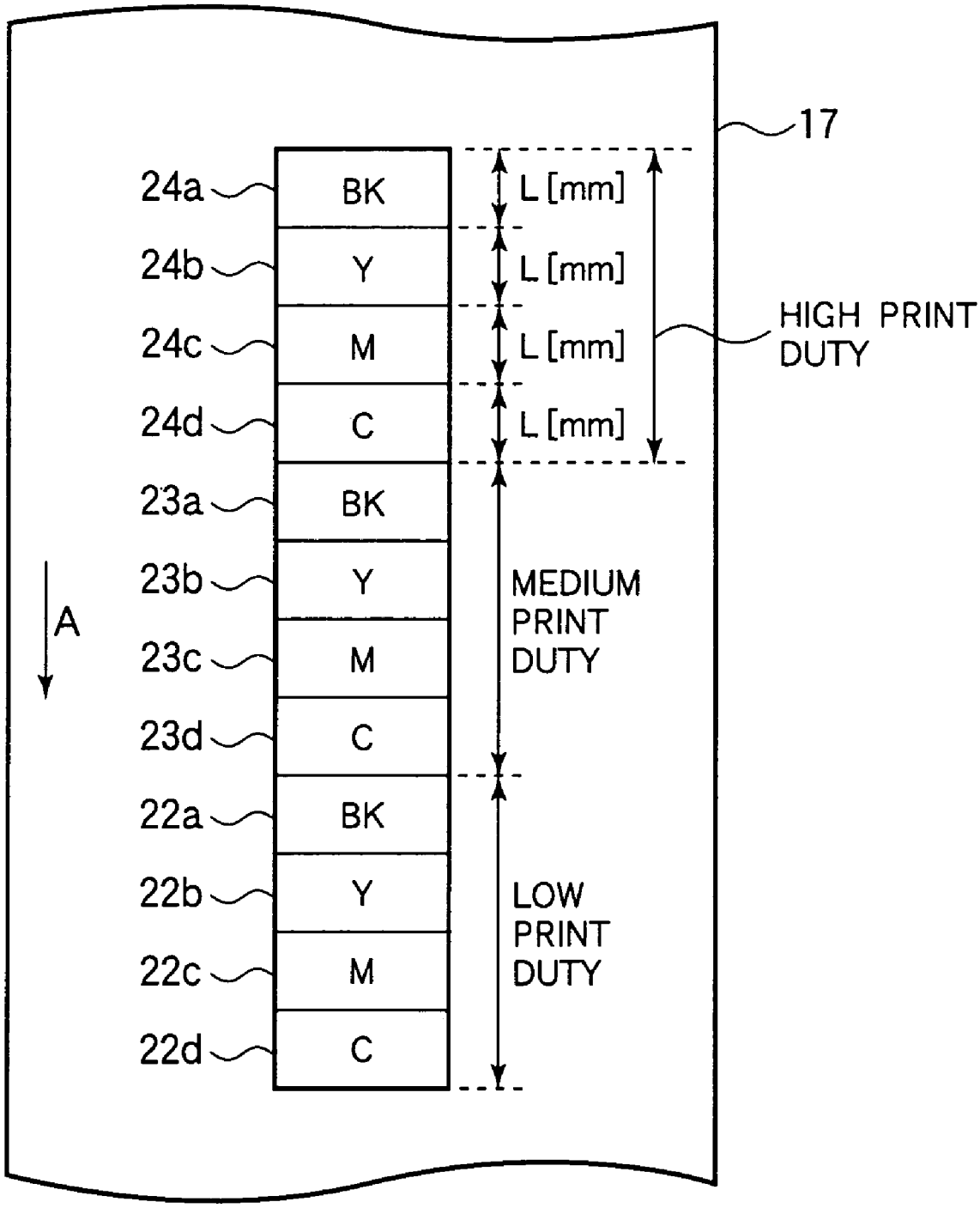
FIG. 2 illustrates a density detection pattern according to the first embodiment.

FIG. 2 illustrates a density detection pattern according to the first embodiment.

The transport belt 17 runs in the A direction. The exposing units 13BK, 13Y, 13M, and 13C image-forming sections illuminate the surfaces of the photoconductive drums 27BK, 27Y, 27M, and 27C in accordance with low duty patterns 22*a*–22*d*, medium duty patterns 23*a*–23*d*, and high duty patterns 24*a*–24*d* of black, yellow, magenta, and cyan, respectively. Then, with the aid of the transfer rollers 12BK, 12Y, 12M, and 12C, the respective patterns are transferred onto the transport belt 17, so that a density detection pattern in FIG. 2 is printed on the transport belt 17. The low, medium, and high duty patterns have a length of L mm and are formed with no space between adjacent patterns.

Then, the shutter 20 is moved to the open position by a shutter drive source such as a solenoid or a motor, not shown. Subsequently, the transport belt 17 runs and the density detector 19 detects a leading edge of the low duty pattern 22*d*. The transport belt 17 further runs over a distance L/2 mm to a position at which the middle of the low duty pattern 22*d* is directly over the density detector 19.

The density detector 19 first detects the density of the low duty pattern 22*d* formed on the transport belt 17. The low duty pattern 22*d* has a light shade of cyan. The density detector 19 detects light reflected back from the low duty pattern 22*d* and the detected density is stored into a memory, not shown.

The density detection operation is performed for the low duty patterns of all colors. Then, the density detection operation is performed for the medium duty patterns of all colors. Finally, the density detection operation is performed for the high duty patterns of all colors.

After all the detected densities have been stored, the shutter 20 is moved back to the closed position and the density detection operation for all colors in the low, medium, and high duties completes.

Figure 3:
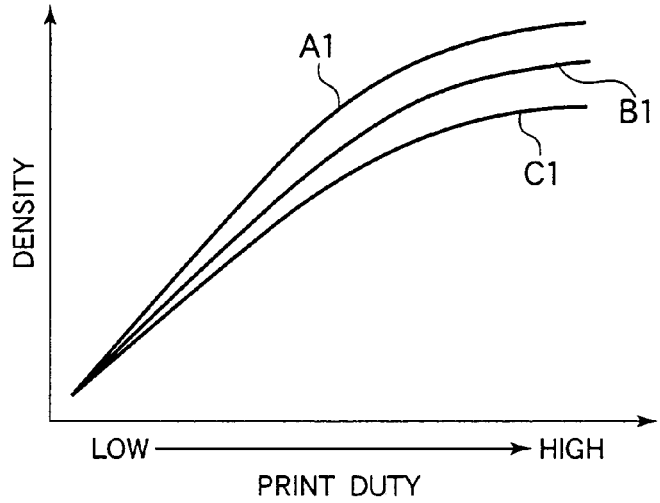
FIG. 3 illustrates the relation between duty and density for different developing voltages to be supplied to the developing unit.

FIG. 3 illustrates the relation between duty and density for different developing voltages to be supplied to the developing unit.

Referring to FIG. 3, Curve B1 shows the relation between duty and density when the developing voltage is adjusted to a predetermined reference value. Curve A1 shows the relation between duty and density when the developing voltage is increased from the reference value to increase the energy to be supplied to the developing unit. Curve C1 shows the relation between duty and density when the developing voltage is decreased from the reference value. Curves A1, B1, and C1 show that the print density increases with increasing developing voltage to be supplied to the developing unit and the print density decreases with decreasing developing voltage.

Figure 4A:
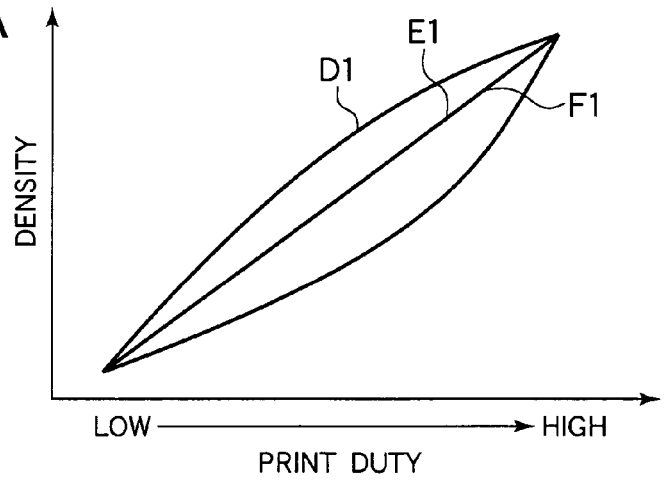
FIG. 4A illustrates the relation between duty and density for different amounts of light to be emitted from the exposing unit such as an LED head or a laser head.
Figure 4B:
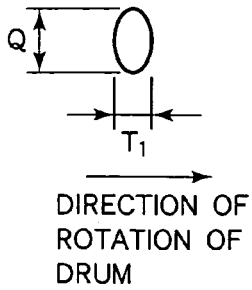
FIGS. 4B–4D illustrate the shape of a dot formed on the photoconductive drum.
Figure 4C:
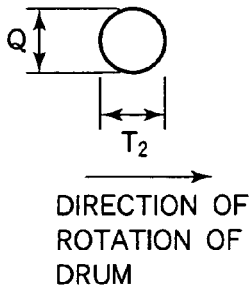
Figure 4D:
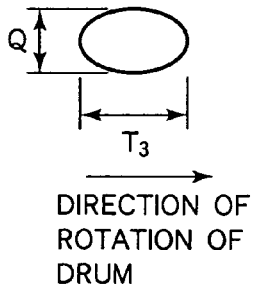

FIG. 4A illustrates the relation between duty and density for different amounts of light to be emitted from the exposing unit such as an LED head or a laser head. For example, the amount of light may be changed by changing the time length during which the head is driven may be corrected. FIGS. 4B–4D illustrate the shape of dots that illuminate the surface of the photoconductive drum. The light emitted from the LED head has an elliptic cross section as shown in FIG. 4B. As the photoconductive drum rotates, an area on the photoconductive drum illuminated by the light changes in shape in accordance with the time length during which the light illuminates the surface of the photoconductive drum. Referring to FIGS. 4B–4D, symbol Q denotes a dimension of the cross section of the light emitted from the LED head. T1–T3 are the time lengths during which the light illuminates the surface of the photoconductive drum. Time length T1–T3 are related such that T1<T2<T3. Thus, the amount of light is adjusted by changing time length during which each light emitting element emits light.

Referring to FIG. 4A, Curve E1 shows the relation between duty and density when the amount of light to be emitted from the exposing unit is adjusted to a predetermined reference value. Curve D1 shows the relation between duty and density when the amount of light to be emitted from the exposing unit is increased from the reference value. Curve F1 shows the relation between duty and density when the amount of light to be emitted from the exposing unit is decreased from the reference value. Curves D1, E1, and F1 show that the density in the medium duty increases with increasing amount of light emitted from the exposing unit and the medium print density decreases with decreasing amount of light emitted from the developing unit.

Then, the detected densities and the target densities in the low, medium, and high duties are put into Equations (1) and (2). Equation (1) produces a correction value Cl in the low, medium, and high duties for each color. Equation (2) produces a correction value Cv in the low, medium, and high duties for each color.

Figure 5:
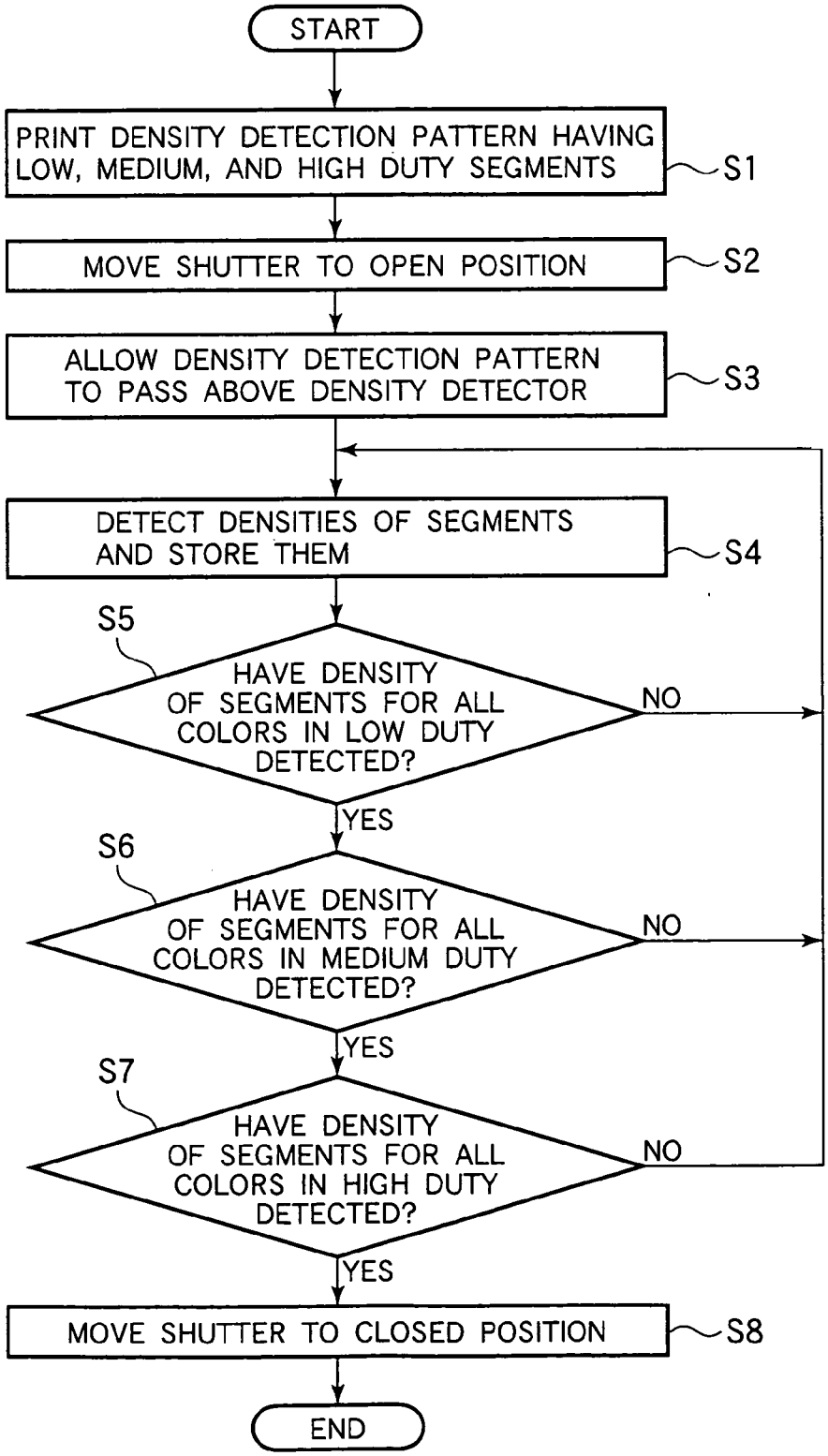
FIG. 5 is a flowchart illustrating the density detection operation according to the first embodiment.

FIG. 5 is a flowchart illustrating the density detection operation according to the first embodiment.

The flowchart will be described as follows:

Step S1: The density detection patterns 22*a*–22*d* for low duty, density detection patterns 23*a*–23*d* for medium duty, and density detection patterns 24*a*–24*d* for high duty are printed on the transport belt 17.

Step S2: The shutter 20 is moved to the open position.

Step S3: The transport belt 17 runs so that the density detection patterns 22*a*–22*d* pass over the density detector 19.

Step S4: The density detector 19 detects the densities of the density detection patterns 22*a*–22*d* and the detected densities are stored.

Step S5: A check is made to determine whether the density detection patterns for all colors in the low duty have been detected. If YES, then the program proceeds to step S6. If NO, the program loops back to step S4.

Step S6: A check is made to determine whether the density detection patterns for all colors in the medium duty have been detected. If YES, then the program proceeds to step S7. If NO, the program loops back to step S4.

Step S7: A check is made to determine whether the density detection patterns for all colors in the high duty have been detected. If YES, then the program proceeds to step S8. If NO, the program loops back to step S4.

Step S8: The shutter 20 is moved to the closed position and the program ends.

In this manner, the densities of the density detection pattern in the low, medium, and high duties are detected, and then the developing voltage to be supplied to the developing unit and the amount of light to be emitted from the exposing unit are calculated for each color. This operation provides good correction results in all ranges of duty.

Second Embodiment

Elements similar to those in the first embodiment have been omitted the description thereof.

In the first embodiment, the density detection pattern is printed on the transport belt 17 only once. Then, the detected densities are used to calculate a correction value to the amount of light to be emitted from the exposing unit for each color and a correction value to the developing voltage to be supplied to the developing unit for each color.

In a second embodiment, a first density detection operation is performed to calculate a correction value to the amount of light to be emitted from the exposing unit for each color. Then, using the correction value to the amount of light, printing conditions for the respective colors are modified. Then, with the printing conditions after correction, a second density detection operation is performed. Then, calculation is made to produce a correction value to the developing voltage to be supplied to the developing unit for each color. Thus, the second embodiment enables more accurate density correction than the first embodiment.

The density detection and density correction operations according to the second embodiment will be described in more detail.

Figure 6:
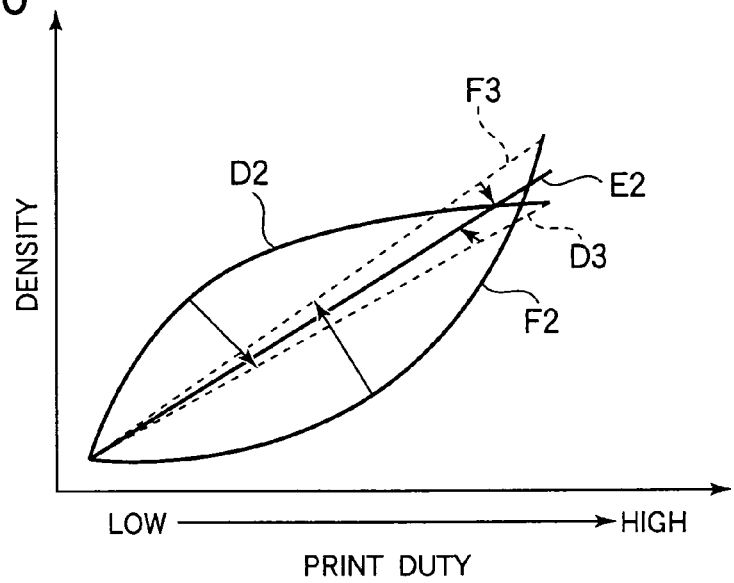
FIG. 6 illustrates the relation between duty and density for different amounts of light emitted from the exposing units according to a second embodiment.

FIG. 6 illustrates the relation between duty and density for different amounts of light emitted from the exposing units according to the second embodiment.

Referring to FIG. 6, Line E2 is the relation between density and duty for a predetermined reference value of the amount of light to be emitted from an exposing unit. Curve D2 shows the relation between duty and density before when the amount of light emitted from the exposing unit is increased from the reference value. Curve F2 shows the relation between duty and density before correction when the amount of light emitted from the exposing unit is decreased from the reference value.

The density detection pattern in FIG. 2 is printed on the transport belt 17. Then, densities in the low, medium, and high duties are detected and stored. The detected density and target density are put into Equation (1) to calculate a correction value to the amount of light to be emitted from the exposing unit for each color. By using the thus obtained correction values of the amounts of light in the low, medium, and high duties, Curves D2 and F2 in FIG. 6 can be corrected into Lines D3 and F3, respectively. Then, the printing conditions for the respective colors are modified with the correction values of the amounts of light.

Using the printing conditions after correction, the density detection pattern in FIG. 2 is again printed on the transport belt 17 and the densities in the low, medium, and high duties are again detected and stored.

The detected densities and target densities are put into Equation (3) to calculate a correction value Cv to the developing voltage to be supplied to the developing unit for each color.

$$Cv=(1/3)(T_L-D_L)/K3+(1/3)(T_M-D_M)/K4+(1/3)(T_H-D_H)/K5 \quad (3)$$

As is clear from the first embodiment (FIG. 3), density increases with increasing developing voltage supplied to the developing unit and decreases with decreasing developing voltage. Thus, Lines D3 and F3 in FIG. 6 can be further corrected into a single line, i.e., Line E2, which is the relation between density and duty for a reference value of the amount of light to be emitted from the exposing unit.

Figure 7:
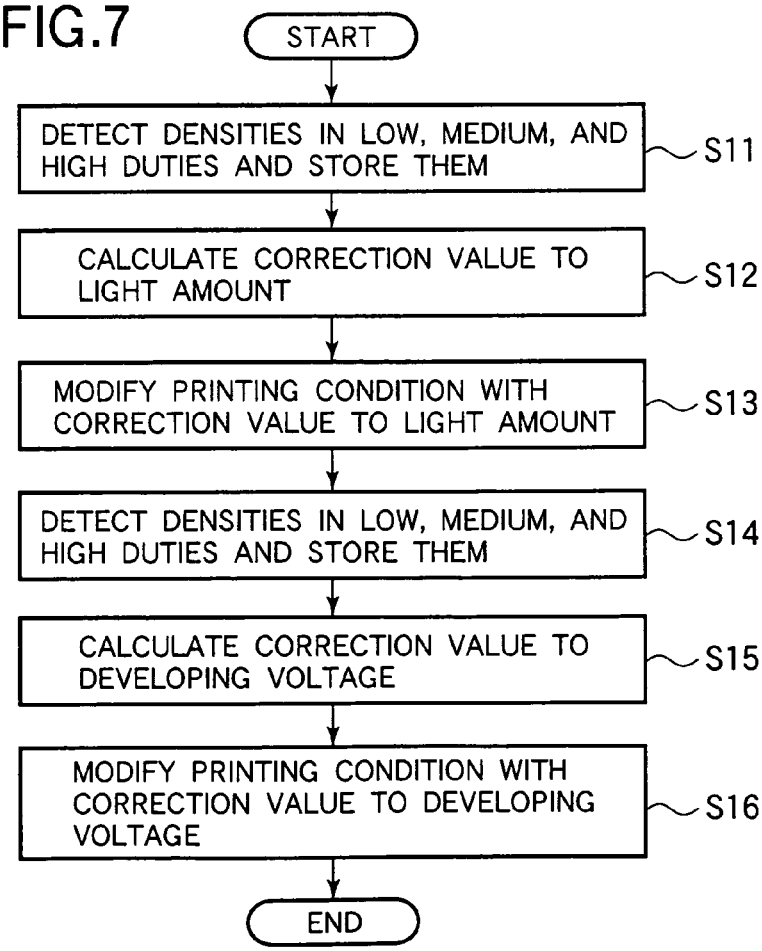
FIG. 7 is a flowchart illustrating the density correction operation according to the second embodiment.

FIG. 7 is a flowchart illustrating the density correction operation according to the second embodiment.

The flowchart will be described as follows:

Step S11: The densities in the low, medium, and high duties are detected and stored.

Step S12: A correction value to the amount of light to be emitted from the exposing unit is calculated.

Step S13: The printing conditions are modified with correction values to the amounts of light to be emitted from the exposing units.

Step S14: The densities in the low, medium, and high duties are detected and stored.

Step S15: A correction value to the amount of light to be emitted from the exposing unit is calculated.

Step S16: The printing conditions are modified with correction values to the developing voltage to be supplied to the developing unit. This completes correction.

Therefore, density detection correction can be performed with good results.

Third Embodiment

Elements similar to those in the first and second embodiments have been omitted the description thereof.

A third embodiment differs from the first and second embodiments in that the density detection operation is performed in the low and medium duties and not performed. in the high duty where variation of density is large. Then, a correction value to the amount of light to be emitted from the exposing unit and a correction value to the developing voltage are calculated for each color.

The density detection and density correction operations will be described.

The densities of the density detection pattern in the low and medium duties are detected. Then, the detected densities and target densities are put into Equation (4) to calculate a correction value Cl to the amount of light to be emitted from the exposing units for each color. The correction value Cv to the amount of light to be emitted from the exposing unit for each color is then modified, thereby correcting the relation between density and duty into a linear relation.

$$Cl=(1/2)\{(T_L-D_L)/K1+(T_M-D_M)/K2\} \quad (4)$$

By using the printing conditions after correction, the density detection pattern is again printed on the transport belt 17. Then, the detected densities and target densities are put into Equation (5) to calculate a correction value to the developing voltage to be supplied to the developing units for each color.

$$Cv=(1/2)\{(T_L-D_L)/K3+(T_M-D_M)/K4\} \quad (5)$$

In Equations (4) and (5), K1 to K4 are the same as those in the first embodiment.

Figure 8:
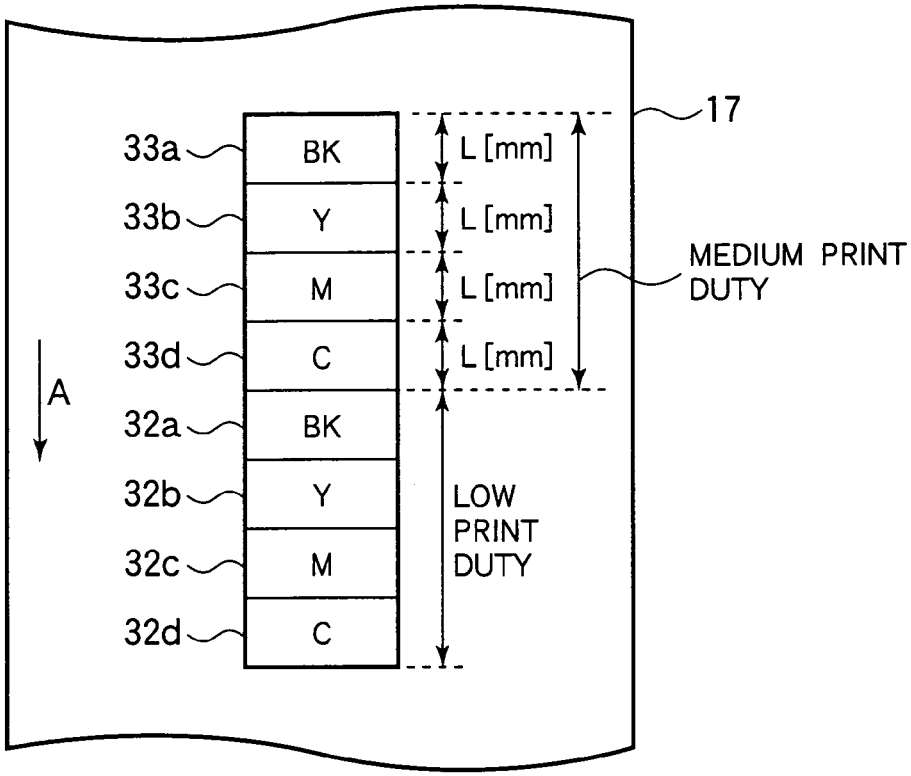
FIG. 8 illustrates a density detection pattern according to the third embodiment.

FIG. 8 illustrates a density detection pattern according to the third embodiment.

The image-forming sections 11BK, 11Y, 11M, and 11C and the transport belt 17 are driven, thereby printing on the transport belt 17 the density detection pattern in the low and medium duties as shown in FIG. 8. The density detection pattern includes a black pattern 32*a*, a yellow pattern 32*b*, a magenta pattern 32*c*, and a cyan pattern 32*d* in the low duty, and a black pattern 33*a*, a yellow pattern 33*b*, a magenta pattern 33*c*, and a cyan pattern 33*d* in the medium duty. The patterns have a length of L mm and are aligned with no space between them.

Then, the shutter 20 is moved by a shutter drive source such as a solenoid or a motor, not shown, to the open position where the shutter 20 is not between the transport belt 17 and the density detector 19, i.e., the density detector directly faces the transport 17. Subsequently, the transport belt 17 runs and the density detector 19 detects a leading edge of the low duty pattern 22*d*. The transport belt 17 further runs over a distance L/2 mm to a position at which the middle of the low duty pattern 32*d* is directly over the density detector 19.

The density detector 19 first detects the density of the low duty pattern 32*d* printed on the transport belt 17. The low duty pattern 32*d* has a light shade of cyan. The density detector 19 detects light reflected back from the low duty pattern 22*d*.

The density detection operation is performed for low duty patterns 32*a*–32*d* of all colors and detected densities are stored in a memory, not shown. Then, the density detection operation is performed for medium duty patterns 33*a*–33*d* of all colors and the detected densities are stored.

After all of the detected densities are stored, the shutter 20 is moved to the closed position, thereby completing the density detection operation.

Figure 9:
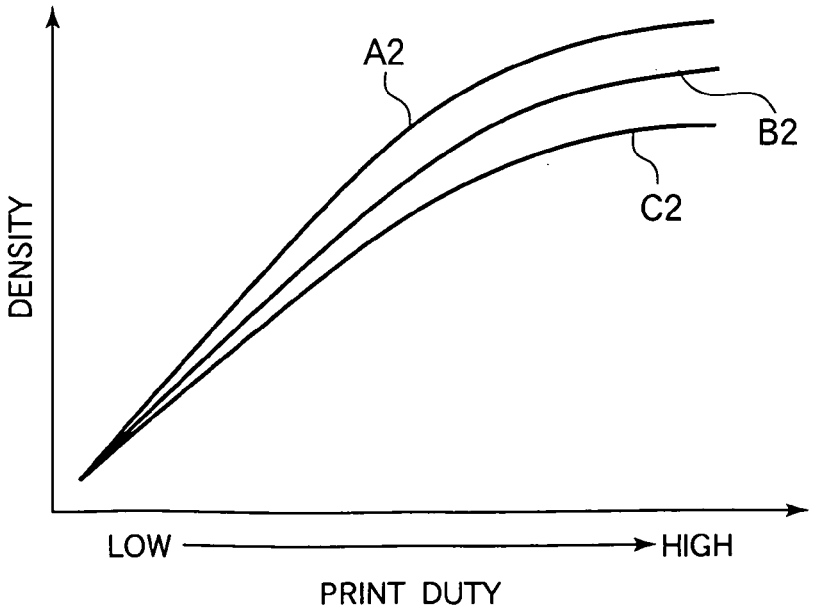
FIG. 9 illustrates variations in density due to the difference in duty according to the third embodiment.

FIG. 9 illustrates variations in density due to the difference in duty according to the third embodiment.

Referring to FIG. 3, Curve B2 shows the relation between duty and density when the developing voltage is adjusted to a predetermined reference value. Curve A2 shows the relation between duty and density when the developing voltage to be supplied to the developing unit is increased from the reference value. Curve C2 shows the relation between duty and density when the developing voltage is decreased from the reference value. Curves A2, B2, and C2 show that the differences among Curves A2, B2, and C2 increase with increasing duty. In other words, variations in density increase with increasing duty.

The detected densities and target densities in the low and medium duties are put into Equation (4) to calculate a correction value to the amount of light to be emitted from the exposing unit for each color. Then, printing conditions for the respective colors are modified with the correction value to the amount of light, thereby obtaining a linear relation between density and duty.

By using the printing conditions after correction, the density detection pattern in FIG. 8 is again printed on the transport belt 17. Then, the density detection operation is performed for low duty patterns 32*a*–32*d* of all colors, and then the detected densities are stored in a memory, not shown. Subsequently, the density detection operation is performed for medium duty patterns 33*a*–33*d* of all colors and detected densities are stored. The detected densities in the low and medium duties and the target densities are put into Equation (5) to calculate a correction value to the developing voltage to be supplied to the developing unit for each color. Then, the printing conditions are modified with the correction value to the developing voltage, thereby obtaining an ultimate linear relation between density and duty.

Figure 10:
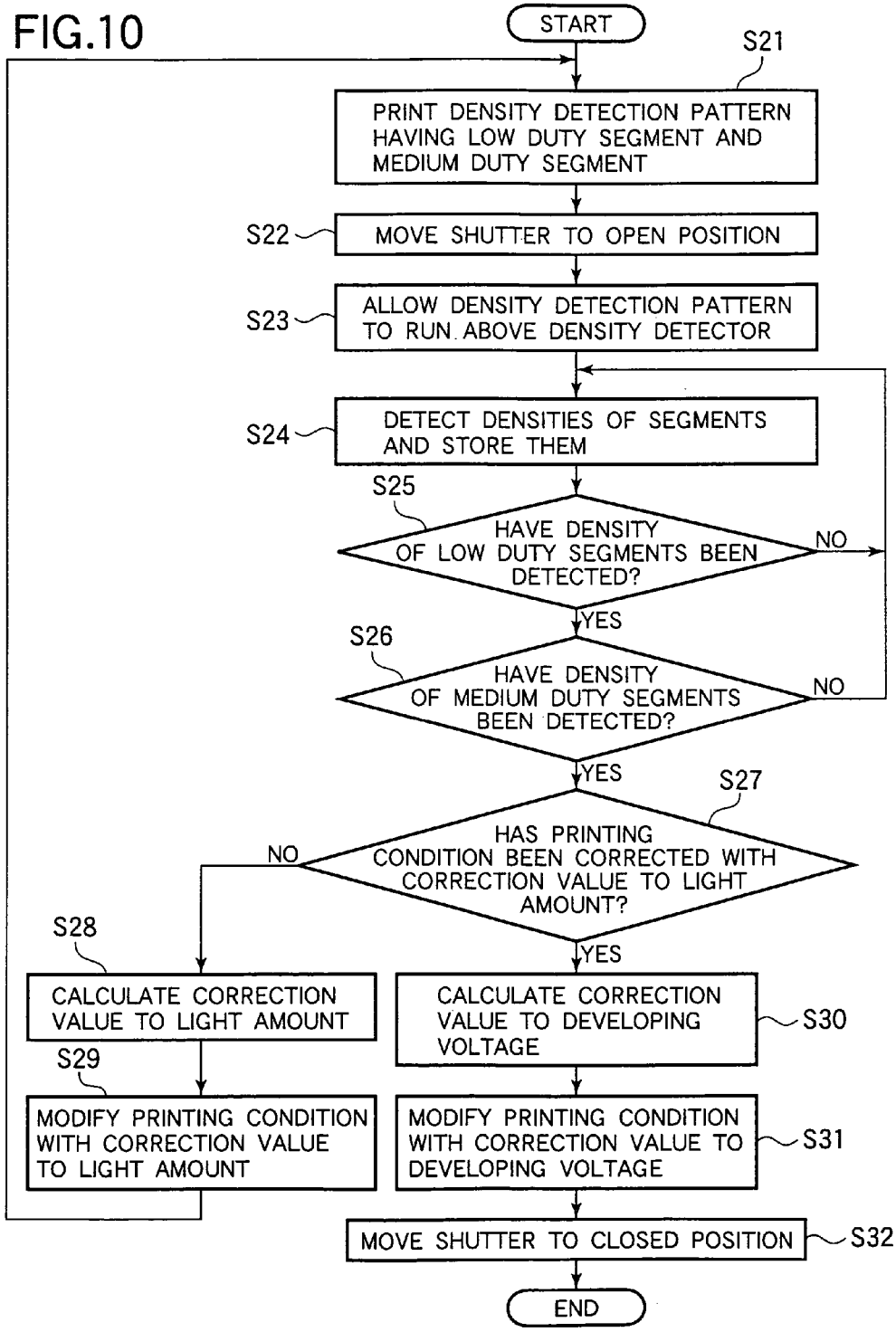
FIG. 10 is a flowchart illustrating the density detection operation according to the third embodiment.

FIG. 10 is a flowchart illustrating the density detection operation according to the third embodiment.

The flowchart will be described.

Step S21: The patterns 32*a*–32*d* in the low duty and patterns 33*a*–33*d* in the medium duty are printed on the transport belt 17.

Step S22: The shutter 20 is moved to the open position.

Step S23: The patterns 32*a*–32*d* run over the density detector 19.

Step S24: The densities of the patterns 32*a*–32*d* are detected and stored.

Step S25: A check is made to determine whether the densities of the patterns 32*a*–32*d* have been detected. If the densities of patterns 32*a*–32*d* in the low duty have been detected, the program proceeds to step S26. If the densities of all patterns have not been detected yet, the program loops back to step S24.

Step S26: A check is made to determine whether the densities of patterns 33*a*–33*d* in the medium duty have been detected. If the densities of patterns 33*a*–33*d* in the medium duty have been detected, the program proceeds to step S27. If the densities of the patterns 33*a*–33*d* in the medium duty have not been detected yet, the program loops back to step S24.

Step S27: A check is made to determine whether the printing conditions have been modified with correction values to the amount of light. If YES, the program jumps to step S30. If NO, the program proceeds to step S28.

Step S28: A correction value to the amounts of light to be emitted from the exposing units is calculated.

Step S29: The printing conditions are modified with the correction value to the amount of light, and then the program loops back to step S21.

Step S30: A correction value to the developing voltages to be supplied to the developing units is calculated.

Step S31: The printing conditions are modified with the correction value to the developing voltages to be supplied to the developing unit, and then the program proceeds to step S32.

Step S32: The shutter 20 is moved to the closed position.

The third embodiment reduces variation in the results of density detection and the time required for detecting density, and optimizes the amount of toner used in printing operations. This enables high-speed printing and improves accuracy in density detection.

Fourth Embodiment

Elements similar to those in the first and second embodiments have been omitted the description thereof.

A fourth embodiment differs from the first to third embodiments in that the amount of light to be emitted from the exposing unit is corrected based on a first density detection operation. The amount of light to be emitted from the exposing unit for each color is corrected by weighting in accordance with variations of density. Then, a second density detection pattern is printed on the transport belt 17 by using the correction values to the amounts of light to be emitted from the exposing units for the respective colors. The correction values are determined by weighting in accordance with variations in density for different duties. Then, the second density detection operation is performed based on the second density detection pattern. A correction value to the developing voltage to be supplied to the developing unit for each color is then calculated based on the difference between the detected densities ad the target density, being corrected by weighting in accordance with variations in density for different duties. Thus, the fourth embodiment is more effective in improving accuracy in density detection.

The density detection and density correction operations will be described. The density detection operation in the fourth embodiment is performed in the same way as the first embodiment, and therefore the description thereof is omitted. Just as in the first embodiment, the density in the medium duty increases with increasing amount of light emitted from the exposing unit and decreases with decreasing amount of light.

Densities in the low and medium duties are detected and stored. For each color, the detected densities and the target densities are put into Equation (6) to calculate a correction value Cl to the amount of light to be emitted from the exposing unit for each color.

$$Cl = (1/W1 + W2)\{D_H \times T_L/T_H) - D_L\} \times W1/K1 + (1/W1 + W2)\{D_H \times (T_M/T_H) - D_M\} \times W2/K2 \quad (6)$$

The printing conditions for the respective colors are modified with the correction value Cl to the amount of light. Then, the density detection operation is again performed using the printing conditions after correction. Then, the detected densities in the low, medium, and high duties are then put into Equation (7) to calculate a correction value Cv to the developing voltage for each color.

$$Cv=\{(T_L-D_L)\times W3/K3+(T_M-D_M)\times W4/K4+(T_H-D_H)\times W5/K5\}/(W3+W4+W5) \quad (7)$$

K1 to K5 are the same as those in the first embodiment. W1 is a weight used for correcting the developing voltage in the medium duty. W2 is a weight used for correcting the amount of light in the medium duty. W1 and W2 are related such that W1≧W2. It is to be noted that the larger the variation, the smaller the weights W1 and W2.

Likewise, W3, W4, and W5 are weights used for correcting the developing voltages in the low, medium, and high duties, respectively. W3, W4, and W5 are related such that W3≧W4≧W5. It is to be noted that the larger the variation, the smaller the weights W3, W4, and W5.

The density detection pattern in FIG. 2 is printed on the transport belt 17. Then, densities in the low, medium, and high duties are detected and stored. Then, the detected densities and target densities are put into Equation (6) to calculate a correction value Cl to the amount of light to be emitted from the exposing unit for each color. By using the correction value Cl to the amount of light, Curves D2 and F2 in solid lines can be corrected into Lines D3 and F3 in dotted lines, respectively.

It is to be noted that as shown in FIG. 9, the larger the duty, the larger the variations in print density. To take the variations in print density into account, Equation (6) incorporates weights indicative of the variations. The printing conditions for the respective colors are modified with the calculated correction value.

By using the printing conditions after correction, the density detection pattern including low duty patterns 22*a*–22*d*, medium duty patterns 23*a*–23*d*, and high duty patterns 24*a*–24*d* is printed on the transport belt 17. For each color, densities in the low, medium, and high duties are detected and stored.

As described in the first embodiment, as shown in FIG. 3, the higher the developing voltage supplied to the developing unit, the higher the print density. Likewise, the lower the developing voltage supplied to the developing unit, the lower the duty.

The detected densities and target densities are then put into Equation (7) to calculate correction values Cv to the developing voltages for the respective colors to be supplied to the developing units. The developing voltages are modified with the correction values Cv.

Therefore, density detection correction can be performed with good results.

Fifth Embodiment

Elements similar to those in the first to fourth embodiments have been omitted the description thereof.

In a fifth embodiment, the amount of light to be emitted from the exposing unit is corrected based on the first density detection operation and a correction value Cl to the amount of light is determined. Then, the second density detection operation is performed by the use of the correction value Cl determined in the first density detection. Then, a correction value is determined based on the difference between the detected densities in the second density detection operation and the target densities. The patterns for the respective colors in the low, medium, and high duties are printed in sequence with no space between them. The pattern in the fifth embodiment is longer than that in other embodiments. Thus, the total length of the density detection pattern is preferably shorter than one complete circumference of the image bearing body in order to eliminate adverse effects of afterimages of preceding pattern segments.

This configuration requires a smaller memory area for data storage than the second embodiment. Because the total length of the density detection pattern is shorter than one complete circumference, the printed density detection pattern is prevented from being adversely affected by an after-image on the surface of the image bearing body, thus improving the density correction accuracy.

The density detection and density correction operations will be described.

Figure 11:
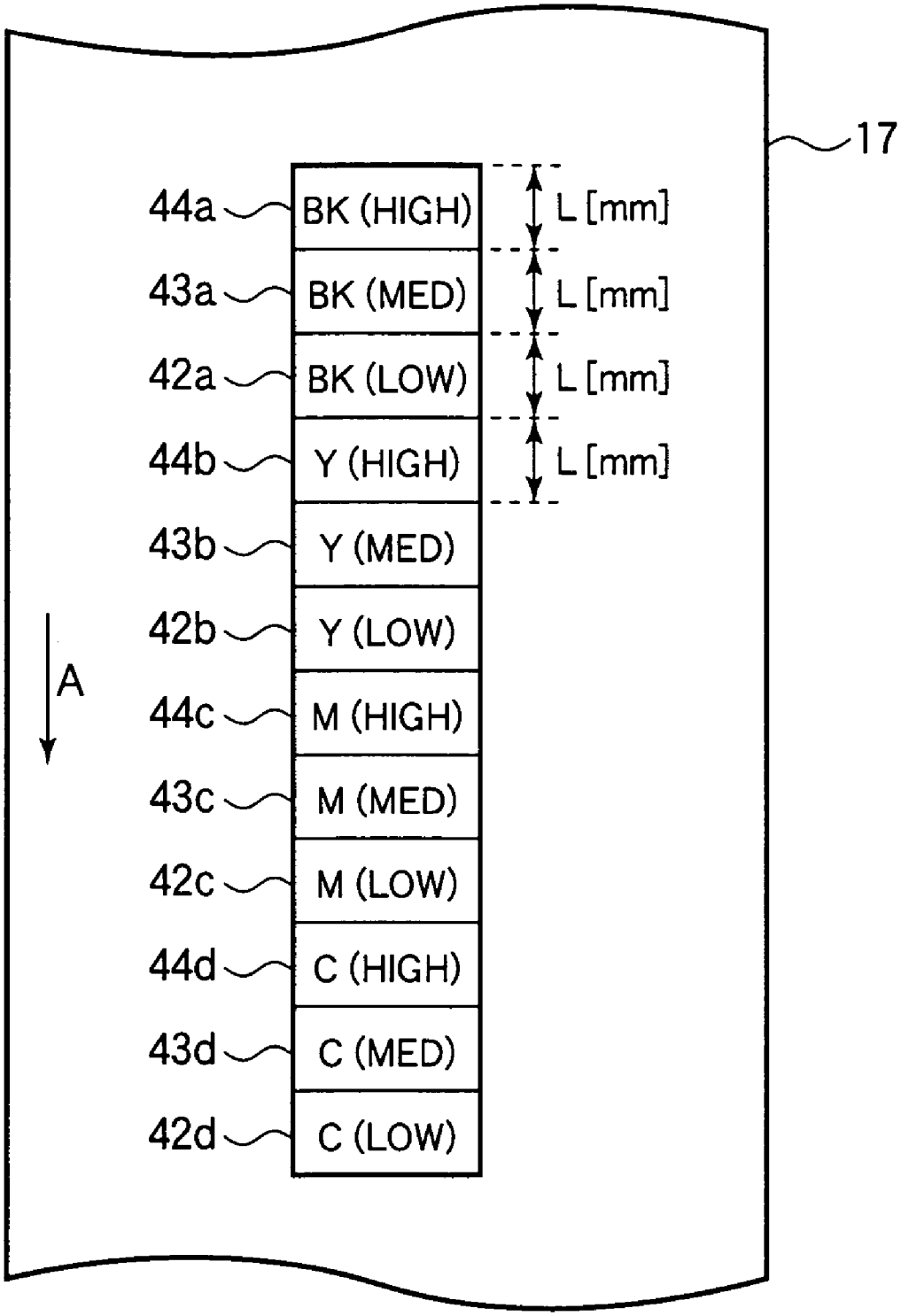
FIG. 11 illustrates a density detection pattern according to a fifth embodiment.

FIG. 11 illustrates a density detection pattern according to the fifth embodiment.

The image-forming sections 11BK, 11Y, 11M, and 11C and the transport belt 17 are driven, thereby printing on the transport belt 17 the density detection pattern in the low and medium duties as shown in FIG. 11. The density detection pattern includes black, yellow, magenta, and cyan patterns. Black patterns 42*a*, 43*a*, and 44*a* are aligned in the order of the low, medium, and high duties. Yellow patterns 42*a*, 43*b*, 44*b* aligned in the order of the low, medium, and high duties. Magenta patterns 42*c*, 43*c*, and 44*c* are aligned in the order of the low, medium, and high duties. Cyan patterns 42*d*, 43*d*, and 44*d* are aligned in the order of the low, medium, and high duties. The patterns have a length of L mm and are aligned with no space therebetween.

Then, the shutter 20 is moved by a shutter drive source such as a solenoid or a motor, not shown, to the open position where the shutter 20 is not between the transport belt 17 and the density detector 19, i.e., the density detector directly faces the transport 17.

Subsequently, the transport belt 17 runs and the density detector 19 detects a leading edge of the low duty pattern 42*d*. The transport belt 17 further runs over a distance L/2 mm to a position at which the middle of the low duty patter 42*d* is directly over the density detector 19.

The detected densities of cyan in the low, medium, and high duties are put into Equation (1) to calculate a correction value to the amount of light to be emitted from the exposing unit for cyan.

Then, the density detection operation is performed for magenta in the low, medium, and high duties. For example, the correction of the amount of light for cyan has been completed by the time correction is performed for magenta. Thus, the memory area that was used for cyan can now be used for magenta.

The detected densities of magenta in the low, medium, and high duties are put into Equation (1) to calculate a correction value to the amount of light to be emitted from the exposing unit for magenta.

Then, density detection operation is performed for yellow in the low, medium, and high duties and the detected densities are stored in the memory. For example, the correction of the amount of light for magenta has been completed by the time correction is performed for yellow. Thus, the memory area that was used for magenta can now be used for yellow.

Finally, the density detection operation is performed for black in the low, medium, and high duties and the detected densities are stored in the memory. The density detection operation for black is accomplished by detecting light reflected by the density detector 19.

After density detection operation for black is completed, the shutter 20 is moved by the shutter drive source to the closed position and the density detection operation completes for all colors.

Then, the printing conditions for the respective colors are modified with the correction values to the amount of light to be emitted from the exposing unit. By using the printing conditions after correction, the detection pattern of FIG. 11 is printed again on the transport belt 17 and the densities are detected again. The detected densities are put into Equation (3) to calculate correction value to the developing voltage to be supplied to the developing unit for each color.

FIG. 4 illustrates the relation between duty and density for different amounts of light to be emitted from the exposing units such as an LED head or a laser head.

As is clear from FIG. 4, the larger the amount of light to be emitted from the exposing unit, the higher the density in the medium duty. Likewise, the smaller the amount of light to be emitted from the exposing unit, the lower the density in the medium duty.

Figure 12:
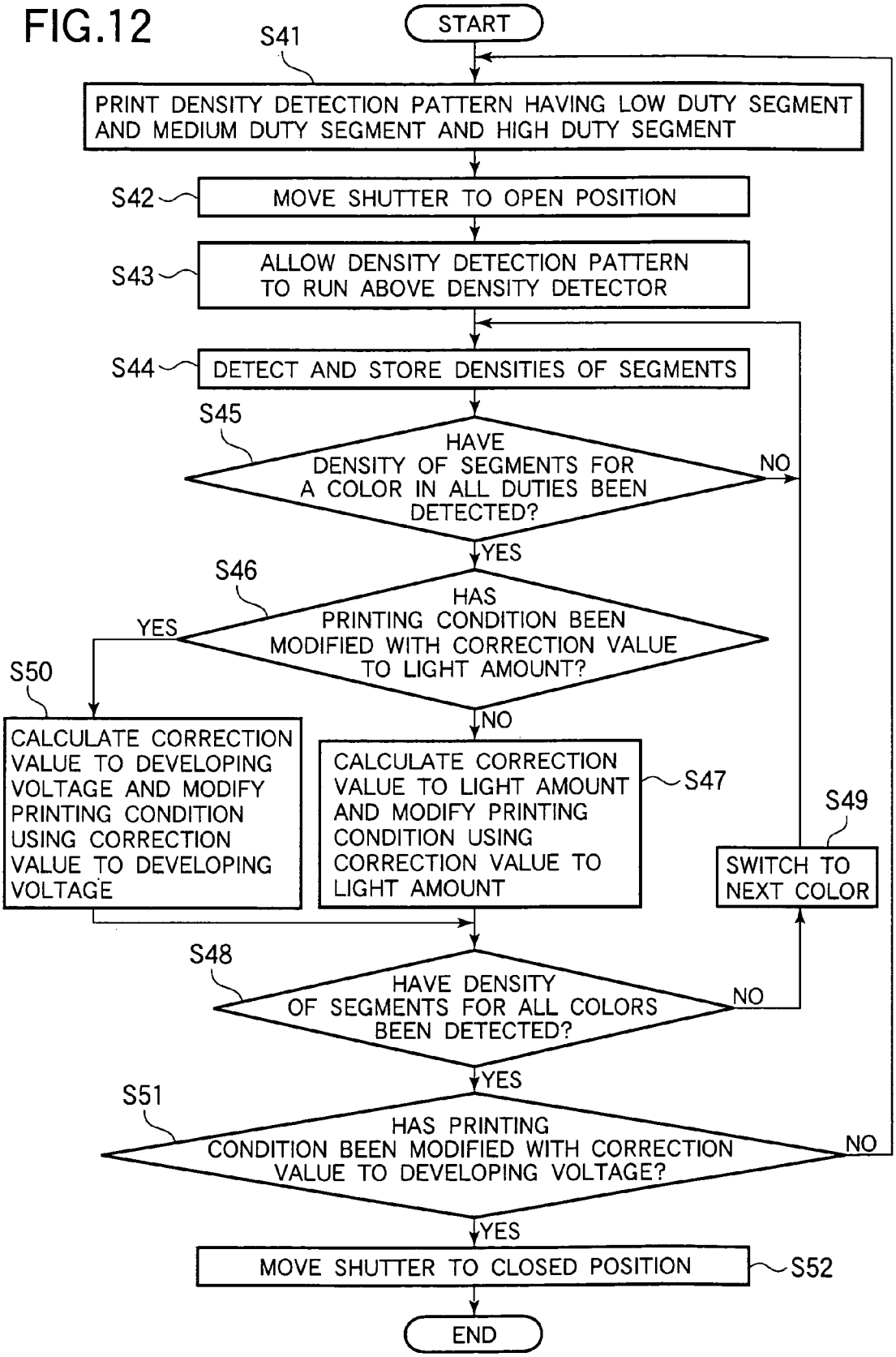
FIG. 12 is a flowchart illustrating the density detection operation according to the fifth embodiment.

FIG. 12 is a flowchart illustrating the density detection operation according to the fifth embodiment.

The flowchart will be described.

Step S41: The density detection pattern of the respective colors in the low, medium, and high duties is printed on the transport belt 17.

Step S42: The shutter 20 is moved to the open position.

Step S43: The transport belt 17 runs to a position where the pattern for a color is directly over the density detector 19.

Step S44: The density of the color is detected and stored.

Step S45: A check is made to determine whether the patterns for all of the colors have been detected. If YES, the program proceeds to step S46. If NO, the program loops back to step S44.

Step S46: A check is made to determine whether the printing conditions have been modified with correction values to the amount of light. If YES, the program jumps to step S50. If NO, the program proceeds to step S47.

Step S47: A correction value to the amount of light to be emitted from the exposing unit is calculated. Then, the printing conditions are modified with the correction value to the amount of light, and then the program proceeds to step S48.

Step S48: A check is made to determined whether the density of segments for all colors have been detected. If YES, the program proceeds to step S51. If NO, the program proceeds to step S49.

Step S49: The density detection of segments is switched to the next color, and then the program jumps back to step S44.

Step 50: A correction value to the developing voltages to be supplied to the developing units is calculated, and the printing conditions are modified with the correction value to the developing voltages to be supplied to the developing unit, and then the program proceeds to step S48.

Step S51: A check is made to determine whether the printing conditions have been modified with the correction value to the developing voltage to be supplied to the developing units. If YES, the program proceeds to step S52. If NO, the program proceeds to step S41.

Step S52: The shutter 20 is moved to the closed position.

{Modification}

The density detection and density correction operations using a modified density detection pattern will be described.

Figure 13:
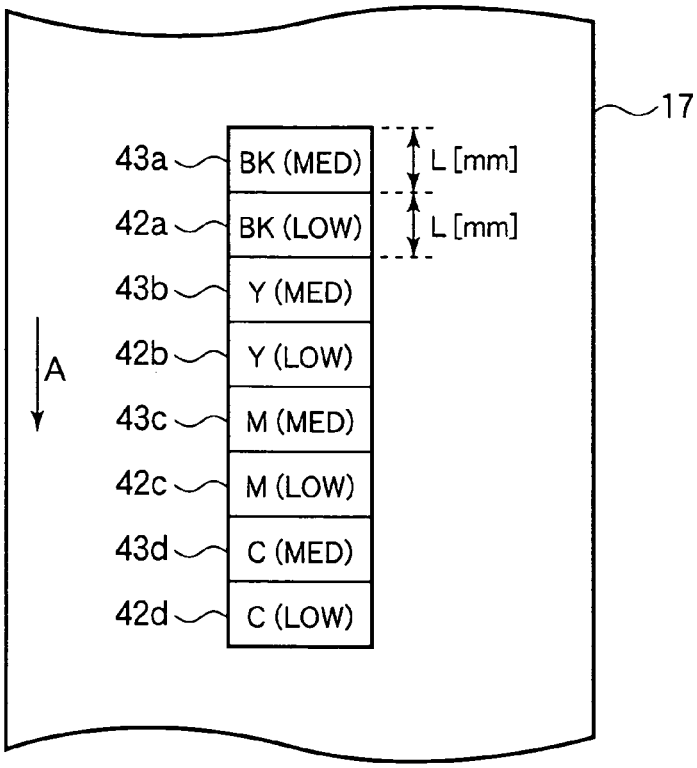
FIG. 13 illustrates the modified density detection pattern according to the fifth embodiment.

FIG. 13 illustrates the modified density detection pattern according to the fifth embodiment.

The density detection operation is performed for the low duty density and medium duty density. Because the density has large variations in the high duty, the density detection operation is not performed for the high duty density. A correction value to the amount of light to be emitted from the exposing unit and a correction value to the developing voltage to be supplied to the developing unit are then calculated for each color based on the detected densities in the low and medium duties.

Sixth Embodiment

Elements similar to those in the first to fifth embodiments have been omitted the description thereof.

In a sixth embodiment, the density detection operation is performed in the low, medium, and high duties. Then, the detected densities are sent to a host apparatus such as a personal computer connected to the image-forming apparatus 10 so that the detected densities can be communicated between the image-forming apparatus 10 and an image-processing section in the host apparatus. Alternatively, the image-forming apparatus may incorporate an image-processing section, in which case, the detected densities are communicated between the image-processing section within the image-forming apparatus instead of the image-processing section in the host apparatus. The image-processing section corrects the relation between duty and density based on the differences between the detected densities and the target densities, thereby stabilizing the density of printed images.

Figure 14:
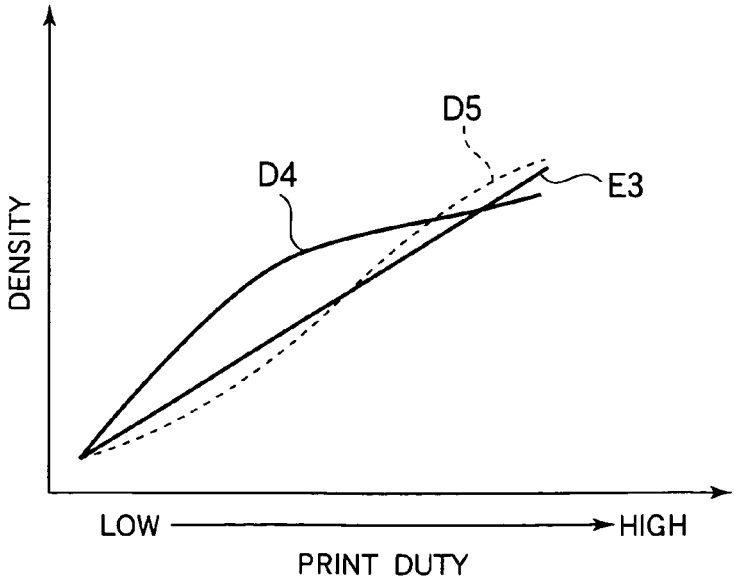
FIG. 14 illustrates the relation between duty and density before and after density correction according to a sixth embodiment.

FIG. 14 illustrates the relation between duty and density before and after density correction.

The method of detecting density is the same as the second embodiment and the description thereof is omitted.

As described in the first and second embodiments (FIG. 4), the density in the medium duty increases with increasing amount of light to be emitted from the exposing unit. Likewise, the density in the medium duty decreases with decreasing amount of light to be emitted from the exposing unit.

In the sixth embodiment, the density detection pattern in FIG. 2 is first printed on the transport belt 17 to detect densities in the low, medium, and high duties. Then, the detected densities are stored into the memory. The detected densities are then put into Equation (1) to calculate a correction value Cl to the amount of light to be emitted from the exposing unit. The printing condition for each color is modified with the thus obtained correction value Cl.

By using the printing conditions after correction, the density detection pattern in FIG. 2 is again printed on the transport belt 17 to detect densities in the low, medium, and high duties. Then, the detected densities are stored into the memory.

The detected densities in the low, medium, and high duties and target densities in the low, medium, and high duties are put into Equation (3) to calculate a correction value Cv to the developing voltage to be supplied to the developing unit. The printing condition for each color is modified with the thus obtained correction value Cv.

Then, by using the printing conditions after the correction of developing voltage, the density detection pattern in FIG. 2 is printed on the transport belt 17 to detect densities in the low, medium, and high duties. The detected densities are stored into the memory.

The resulting relation D5 between detected density and duty may be different from the target relation E3 as shown in FIG. 14. Referring to FIG. 14, Curve D4 shows the relation between density and duty before correction when the amount of light to be emitted from the exposing unit is increased. Line E3 shows the target relation between density and duty.

The detected densities are sent to the image-processing section of the host apparatus, which in turn detects the relation between duty and density of the image-forming apparatus 10 and performs an image-processing operation to obtain a relation that coincides Line E3 in FIG. 14.

Figure 15:
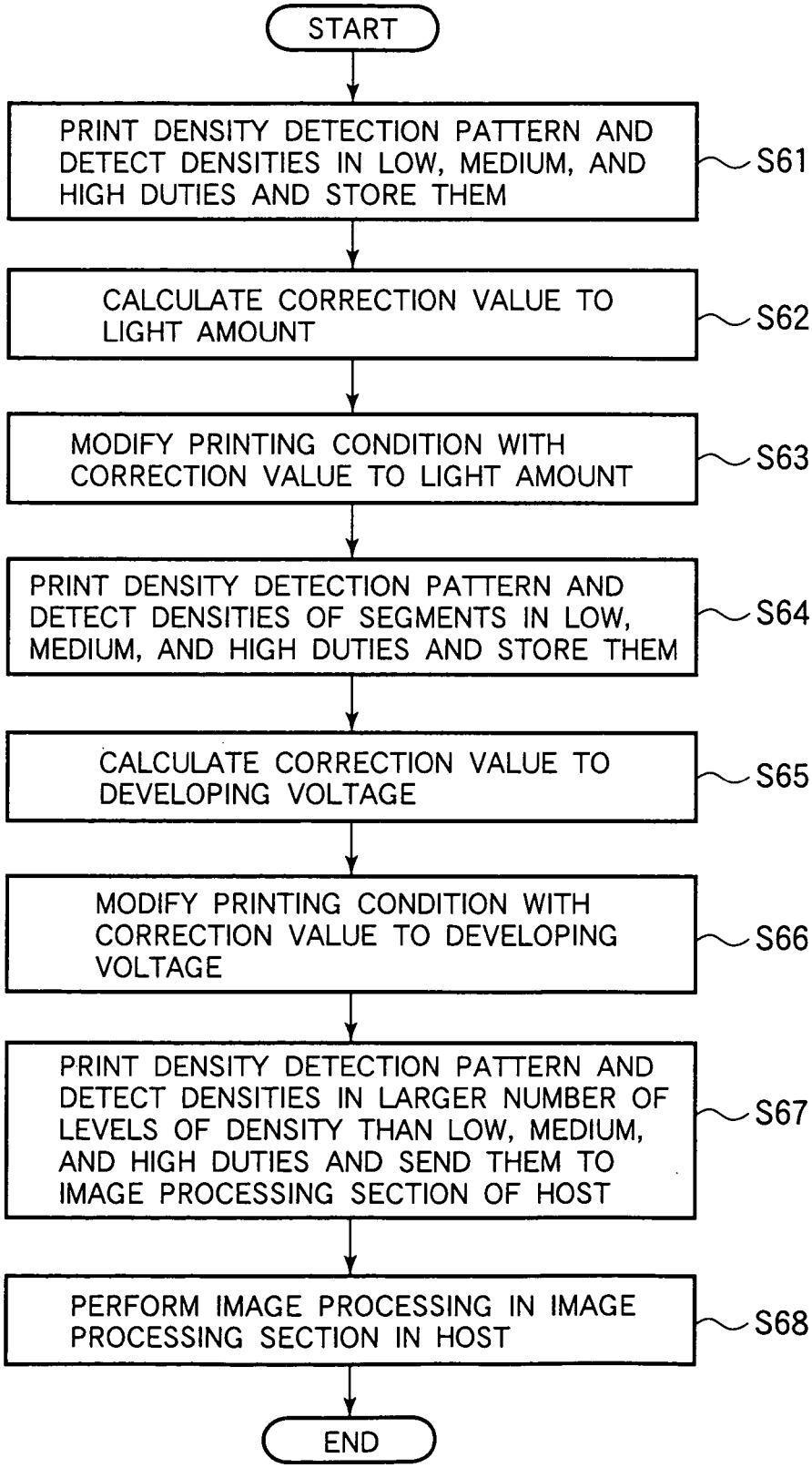
FIG. 15 is a flowchart illustrating the density correction operation according to the sixth embodiment.

FIG. 15 is a flowchart illustrating the density correction operation according to the sixth embodiment. The flowchart will be described.

Step S61: The density detection pattern is printed and densities of the respective colors in the low, medium, and high duties are detected and stored.

Step S62: A correction value to the amount of light to be emitted from the exposing units is calculated.

Step S63: The printing condition for each color is modified with the correction value to the amount of light to be emitted from the exposing unit.

Step S64: The density detection pattern is printed and densities of the respective colors in the low, medium, and high duties are detected and stored.

The density detection pattern is printed on the transport belt. Then, the densities of the respective colors in the low, medium, and high duties are again detected and stored.

Step S65: A correction value to the developing voltages to be supplied to the developing units is calculated.

Step S66: The printing condition for each color is modified with the correction value to the developing voltage to be supplied to the developing unit.

Step S67: The density detection pattern is printed and densities of the respective colors in a plurality of duties are detected and sent to the image-processing section of the host apparatus. These densities describe the overall density characteristic of the printer and measured in a larger number of levels of density than low, medium, and high densities.

Step S68: The image-processing section of the host apparatus performs image processing.

As described above, the density correction is made based on the densities sent to the image-processing section of the host apparatus where an image-processing operation takes place to ultimately obtain a density characteristic. The thus obtained density characteristic is very close to the target characteristic as depicted at Line E3 in FIG. 14, stabilizing the density of printed images.

While the first to sixth embodiments have been described with respect to a transport belt that serves as a transfer medium onto which the density detection pattern is transferred, but the density detection pattern may also be printed on print paper transported on the transport belt.

The embodiments have been described with respect to a direct transfer type image-forming apparatus in which ordinary image data is transferred from the image-forming section directly onto a print medium such as print paper. The invention is also applicable to an intermediate transfer type image-forming apparatus in which a toner image is transferred from an image-forming section to an intermediate transfer body such as a belt or a rotating body and subsequently transferred onto a print medium such as print paper.

The density detection pattern is transferred onto the intermediate transfer body and the density correction is performed to detect the density of the density detection pattern transferred onto the intermediate transfer body.

The first to sixth embodiments have been described with respect to the correction of developing voltage, which is energy to be supplied to the developing unit. The density correction may be applied to a supply voltage or a charging voltage instead of a developing voltage. Moreover, density correction may be made in combination of the supply voltage, charging voltage, and developing voltage.

The first to sixth embodiments have been described with respect to a case in which correction is made to the amount of LED light or laser light that serves as energy for forming an image. In order to correct the amount of light, the time length during which the head is driven may be corrected.

Further, the charging voltage may be corrected to obtain a characteristic similar to that obtained by correcting the amount of light for the head.

Figure 16:
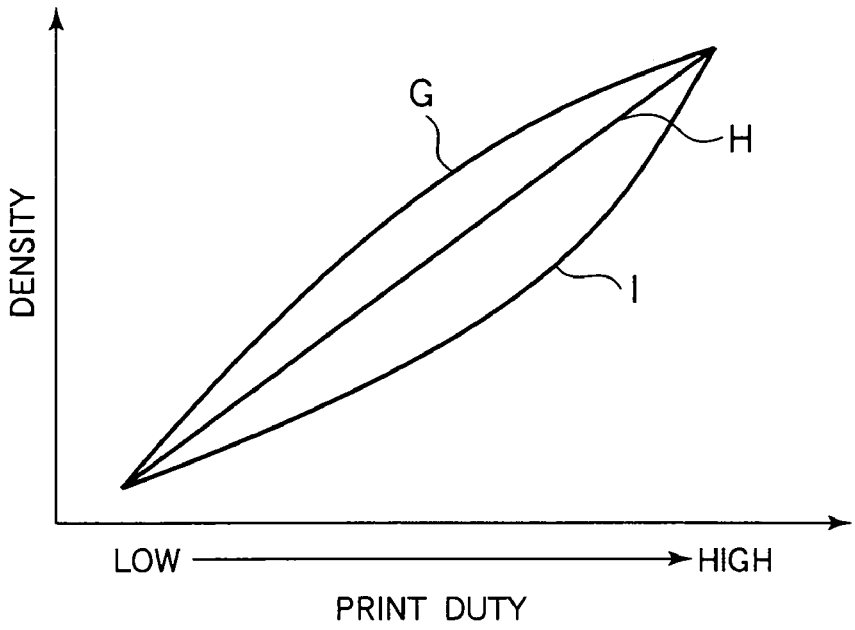
FIG. 16 illustrates the relation between duty and density for different charging voltages in the first to sixth embodiments.
Figure 17:
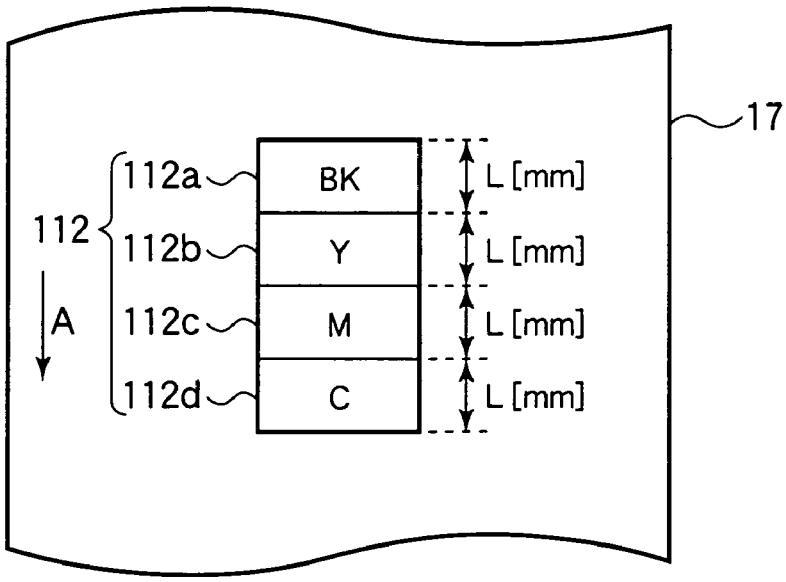
FIG.17 CONVENTIONAL ART
FIG. 17 illustrates a conventional density detection pattern.

FIG. 16 illustrates the relation between duty and density for different charging voltages in the first to sixth embodiments.

Referring to FIG. 16, Curve H shows the relation between duty and density when the charging voltage is adjusted to a predetermined reference value. Curve G shows the relation between duty and density when the developing voltage is decreased from the reference value. Curve I shows the relation between duty and density when the developing voltage is increased from the reference value. Curves H, G, and I reveal that the charging voltage may be corrected instead of correcting the amount of light to be emitted from the exposing unit. Moreover, the amount of light and the charging voltage may be corrected in combination.

The first to sixth embodiment have been described with respect to a case in which the image-forming sections 11BK, 11Y, 11M, and 11C are aligned in this order from the upstream end to the downstream end of the path of the print medium 16. The order in which the image-forming sections are aligned is not limited to this and the image-forming sections may be aligned in any order.

While the first to sixth embodiment have been described with respect to a case in which four image-forming sections are employed, the number of image-forming sections is not particularly important. In fact, any number of image-forming sections may be used.

In the sixth embodiment, the densities that are sent to the host apparatus have been described in a low duty, a medium duty, and a high duty. The number of levels of duty may be more than three.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image-forming apparatus comprising:

at least one image-forming section that has an exposing unit and a developing unit, said at least one image-forming section printing an image of a density detection pattern having a plurality of pattern segments of different duties expressed in terms of a number of dots per unit area, the image being printed on a print medium under a predetermined printing condition;

a density detector that outputs detection values indicative of densities of the plurality of pattern segments printed on the print medium; and a controller that determines a correction value based on differences between the detection values and corresponding target values of the plurality of pattern segments, the correction value being weighted in accordance with the detection values of the plurality of pattern segments, and being used to modify the printing condition.

2. The image-forming apparatus according to claim 1, wherein said at least one image-forming section is one of a plurality of image-forming sections that print images of different colors.

3. The image-forming apparatus according to claim 1 wherein said controller controls said image-forming section and said density detector to perform:

a first density detection operation in which said at least one image-forming section forms the image of density detection pattern with a first printing condition, and then said controller calculates a first correction value based on the density of the plurality of pattern segments detected by said density detector, said controller producing a second printing condition using the first correction value; and a second density detection operation in which the image-forming section forms the image of density detection pattern with the second printing condition, and then said controller calculates a second correction value based on the density of the plurality of pattern segments detected by said density detector, said controller producing a third printing condition using the second correction value.

4. The image-forming apparatus according to claim 3, wherein the plurality of pattern segments include a low duty segment, a medium duty segment, and a high duty segment;

wherein the low duty segment has a density not more than 50%, the medium duty segment has a density in the range of 30 to 80%, and the high duty segment has a density not less than 60%;

wherein densities of the low, medium, and high duty segments are related such that $D_L<D_M<D_H$ where $D_L$ is the density in the low duty, $D_M$ is the density in the medium duty, and $D_H$ is the density in the high duty.

5. The image-forming apparatus according to claim 4, wherein the first correction value indicates a correction to an amount of light emitted from the exposing unit and the second correction value indicates a correction to a developing voltage applied to the developing unit, wherein the first correction value is calculated by Equation (1) and the second correction value is calculated by Equation (3)

$$Cl=(1/2)\{D_H\times(T_L/T_H)-D_L\}/K1+(1/2)\{D_H\times(T_M/T_H)-D_M\}/K2 \quad (1)$$

$$Cv=(1/3)(T_L-D_L)/K3+(1/3)(T_M-D_M)/K4+(1/3)(T_H-D_H)/K5 \quad (3)$$

where Cl is the first correction value,

Cv is the second correction value, $D_H$ is a density at a high duty not less than 60%, $D_M$ is a detected density at a medium duty in the range of 30 to 80%, $D_L$ is a density at a low duty not more than 50%, $T_H$ is a target density at the high duty, $T_M$ is a target density at the medium duty, $T_L$ is a detected density at the low duty, K1 is a rate of change of $D_L$ per unit change of the amount of light emitted from the exposing unit, K2 is a rate of change of $D_M$ per unit change of the amount of light emitted from the exposing unit, K3 is a unit change of $D_L$ per unit change of the developing voltage, K4 is a unit change of $D_M$ per unit change of the developing voltage, K5 is a unit change of $D_H$ per unit change of the developing voltage, and $D_L$, $D_M$, and $D_H$ are related such that $D_L<D_M<D_H$.

6. The image-forming apparatus according to claim 5, wherein the detected detection values are sent to a host apparatus.

7. The image-forming apparatus according to claim 3, wherein the plurality of pattern segments include a low duty segment and a medium duty segment;

wherein the low duty segment has a density not more than 50% and the medium duty segment has a density in the range of 30 to 80%;

wherein densities of the low duty and the medium duty segments are related such that $D_L<D_M$ where $D_L$ is the density in the low duty, and $D_M<$ is the density in the medium duty.

8. The image-forming apparatus according to claim 7, wherein the first correction value indicates a correction to an amount of light emitted from the exposing unit and the second correction value indicates a correction to a developing voltage applied to the developing unit, wherein the first correction value is calculated by Equation (4) and the second correction value is calculated by Equation (5)

$$Cl=(1/2)\{(T_L-D_L)/K1+(T_M-D_M)/K2\} \quad (4)$$

$$Cv=(1/2)\{(T_L-D_L)/K3+(T_M-D_M)/K4\} \quad (5)$$

where Cl is the first correction value,

Cv is the second correction value, $D_M$ is a detected density at the medium duty, $D_L$ is a density at the low duty, $T_M$ is a target density at the medium duty, $T_L$ is a detected density at the low duty, K1 is a rate of change of $D_L$ per unit change of the amount of light emitted from the exposing unit, K2 is a rate of change of $D_M$ per unit change of the amount of light emitted from the exposing unit, K3 is a unit change of $D_L$ per unit change of the developing voltage, K4 is a unit change of $D_M$ per unit change of the developing voltage, and $D_L$ and $D_M$ are related such that $D_L<D_M$.

9. The image-forming apparatus according to claim 7, wherein the first correction value indicates a correction to an amount of light emitted from the exposing unit and the second correction value indicates a correction to a developing voltage applied to the developing unit, wherein the first correction value being calculated by Equation (6) and the second correction value being calculated by Equation (7)

$$Cl=(1/(W1+W2)\{D_H\times(T_L/T_H)-D_L\}\times W1/K1+(1/(W1+W2)\{D_H\times(T_M/T_H)-D_M\}\times W2/K2 \quad (6)$$

$$Cv=\{(T_L-D_L)\times W3/K3+(T_M-D_M)\times W4/K4+(T_H-D_H)\times W5/K5\}/(W3+W4+W5 \quad (7)$$

where Cl is the first correction value,

Cv is the second correction value, $D_H$ is a density at the high duty, $D_M$ is a detected density at the medium duty, $D_L$ is a density at the low duty, $T_H$ is a target density at the high duty, $T_M$ is a target density at the medium duty, $T_L$ is a detected density at the low duty, K1 is a rate of change of $D_L$ per unit change of the amount of light emitted from the exposing unit, K2 is a rate of change of $D_M$ per unit change of the amount of light emitted from the exposing unit, K3 is a unit change of $D_L$ per unit change of the developing voltage, K4 is a unit change of $D_M$ per unit change of the developing voltage, K5 is a unit change of $D_H$ per unit change of the developing voltage, $D_L$, $D_M$, and $D_H$ are related such that $D_L<D_M<D_H$, W1 is a weight used for correcting the amount of light in the low duty, W2 is a weight used for correcting the amount of light in the medium duty, W1 and W2 are related such that W1≧W2, and W3, W4, and W5 are weights used for correcting the developing voltages in the low, medium, and high duties, respectively, and W3, W4, and W5 are related such that W3≧W4≧W5.

10. The image-forming apparatus according to claim 1, wherein said controller controls said image-forming section and said density detector to perform:

a first density detection operation in which said at least one image-forming section forms the image of density detection pattern with a printing condition, and then said controller calculates a correction value based on the density of the plurality of pattern segments detected by said density detector.

11. The image-forming apparatus according to claim 10, wherein the plurality of pattern segments include a low duty segment, a medium duty segment, and a high duty segment;

wherein the low duty segment has a density not more than 50%, the medium duty segment has a density in the range of 30 to 80%, and the high duty segment has a density not less than 60%;

wherein densities of the low, medium, and high duty segments are related such that $D_L<D_M<D_H$ where $D_L$ is the density in the low duty, $D_M$ is the density in the medium duty, and $D_H$ is the density in the high duty.

12. An image-forming apparatus comprising:

at least one image-forming section that has an exposing unit and a developing unit, said at least one image-forming section printing an image of a density detection pattern having a plurality of pattern segments of different duties, the image being printed on a print medium under a predetermined printing condition;

a density detector that outputs detection values indicative of densities of the plurality of pattern segments printed on the print medium; and a controller that determines a correction value based on the detection values and corresponding target values to modify the printing condition, wherein said controller controls said image-forming section and said density detector to perform:

a density detection operation in which said at least one image-forming section forms the image of density detection pattern with a printing condition, and then said controller calculates a first correction value and a second correction value based on the density of the plurality of pattern segments detected by said density detector, wherein the plurality of pattern segments include a low duty segment, a medium duty segment, and a high duty segment;

wherein the low duty segment has a density not more than 50%, the medium duty segment has a density in the range of 30 to 80%, and the high duty segment has a density not less than 60%; wherein densities of the low, medium, and high duty segments are related such that $D_L<D_M<D_H$ where $D_L$ is the density in the low duty, $D_M$ is the density in the medium duty, and $D_H$ is the density in the high duty, wherein the first correction value indicates a correction to an amount of light emitted from the exposing unit and the second correction value indicates a correction to a developing voltage applied to the developing unit, wherein the first correction value being calculated by Equation (1) and the second correction value being calculated by Equation (2);

$$Cl=(1/2)\{D_H\times(T_L/T_H)-D_L\}/K1+(1/2)\{D_H\times(T_M/T_H)-D_M\}/K2 \quad (1)$$

$$Cv=(1/3)\{T_L-(D_L+\Delta L\times K1)\}/K3+(1/3)\{T_M-(D_M+\Delta L\times K2)\}/K4+(1/3)\{T_H-D_H\}/K5 \quad (2)$$

where Cl is the first correction value,

Cv is the second correction value, $D_H$ is a density at the high duty, $D_M$ is a detected density at the medium duty, $D_L$ is a density at the low duty, $\Delta L$ is a change of amount of light, $T_H$ is a target density at the high duty, $T_M$ is a target density at the medium duty, $T_L$ is a detected density at the low duty, K1 is a rate of change of $D_L$ per unit change of the amount of light emitted from the exposing unit, K2 is a rate of change of $D_M$ per unit change of the amount of light emitted from the exposing unit, K3 is a unit change of $D_L$ per unit change of the developing voltage, K4 is a unit change of $D_M$ per unit change of the developing voltage, K5 is a unit change of $D_H$ per unit change of the developing voltage, and $D_L$, $D_M$, and $D_H$ are related such that $D_L<D_M<D_H$.

13. The image-forming apparatus according to claim 1, wherein energy for the developing section to develop the image is at least one of a developing voltage applied to a developing roller, a supply voltage applied to a toner supplying roller, and a charging voltage applied to a charging roller.

14. The image-forming apparatus according to claim 1, wherein energy for the image-forming section is an amount of light emitted from either an LED or a laser.

15. An image-forming apparatus comprising:

at least one image-forming section that has an exposing unit and a developing unit, said at least one image-forming section transferring an image of a density detection pattern having a plurality of pattern segments of different duties expressed in terms of a number of dots per unit area, the image being transferred from the image forming section to an intermediate transfer body under a predetermined printing condition;

a density detector that outputs detection values indicative of densities of the plurality of pattern segments transferred to the intermediate transfer body; and a controller that determines a correction value based on differences between the detection values and corresponding target values of the plurality of pattern segments, the correction value being weighted in accordance with the detection values of the plurality of pattern segments, and being used to modify the printing condition.

16. The image-forming apparatus according to claim 15, wherein said controller controls said image-forming section and said density detector to perform:

a first density detection operation in which said at least one image-forming section forms the image of density detection pattern with a first printing condition and then said controller calculates a first correction value based on the density of the plurality of pattern segments detected by said density detector, said controller producing a second printing condition using the first correction value; and a second density detection operation in which the image-forming section forms the image of density detection pattern with the second printing condition, and then said controller calculates a second correction value based on the density of the plurality of pattern segments detected by said density detector, said controller producing a third printing condition using the second correction value.

17. The image-forming apparatus according to claim 15, wherein said controller controls said image-forming section and said density detector to perform:

a first density detection operation in which said at least one image-forming section forms the image of density detection pattern with a printing condition, and then said controller calculates a correction value based on the density of the plurality of pattern segments detected by said density detector.

18. An image-forming apparatus comprising:

at least one image-forming section that has an exposing unit and a developing unit, said at least one image-forming section transferring an image of a density detection pattern having a plurality of pattern segments of different duties expressed in terms of a number of dots per unit area, the image being transferred from the image forming section onto a transport belt under a predetermined printing condition;

a density detector that outputs detection values indicative of densities of the plurality of pattern segments transferred onto the transport belt; and a controller that determines a correction value based on differences between the detection values and corresponding target values of the plurality of pattern segments, the correction value being weighted in accordance with the detection values of the plurality of pattern segments, and being used to modify the printing condition.

19. The image-forming apparatus according to claim 18 wherein said controller controls said image-forming section and said density detector to perform:

a first density detection operation in which said at least one image-forming section forms the image of density detection pattern with a first printing condition, and then said controller calculates a first correction value based on the density of the plurality of pattern segments detected by said density detector, said controller producing a second printing condition using the first correction value; and a second density detection operation in which the image-forming section forms the image of density detection pattern with the second printing condition, and then said controller calculates a second correction value based on the density of the plurality of pattern segments detected by said density detector, said controller producing a third printing condition using the second correction value.

20. The image-forming apparatus according to claim 18, wherein said controller controls said image-forming section and said density detector to perform:

a first density detection operation in which said at least one image-forming section forms the image of density detection pattern with a printing condition, and then said controller calculates a correction value based on the density of the plurality of pattern segments detected by said density detector.

* * * * *